US007725983B2

(12) United States Patent
O'Neal

(10) Patent No.: US 7,725,983 B2
(45) Date of Patent: Jun. 1, 2010

(54) RECOVERY TANK ARRANGEMENT FOR A CLEANING APPARATUS

(75) Inventor: David L. O'Neal, Louisville, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 1388 days.

(21) Appl. No.: 11/009,637

(22) Filed: Dec. 10, 2004

(65) Prior Publication Data

US 2006/0123585 A1 Jun. 15, 2006

(51) Int. Cl.
*A47L 7/00* (2006.01)

(52) U.S. Cl. ..... 15/320; 15/322; 15/328; 15/338; 15/414

(58) Field of Classification Search ..... 15/320, 15/322, 328, 338, 414
See application file for complete search history.

(56) References Cited

U.S. PATENT DOCUMENTS

| | | | | |
|---|---|---|---|---|
| 3,460,184 | A | 8/1969 | Dyer | |
| 3,486,532 | A | 12/1969 | Sawada | |
| 3,520,012 | A | 7/1970 | Carabet et al. | |
| 3,540,072 | A | 11/1970 | Wolter et al. | |
| 3,572,393 | A | 3/1971 | Eisert | |
| 4,429,433 | A | 2/1984 | Burgoon | |
| 5,395,278 | A | 3/1995 | Dickhut | |
| 5,443,362 | A | 8/1995 | Crites et al. | |
| 5,467,502 | A | 11/1995 | Johnson et al. | |
| 5,500,977 | A | 3/1996 | McAllise et al. | |
| 5,761,763 | A * | 6/1998 | McAllise et al. | 15/320 |
| 5,860,188 | A | 1/1999 | Maurer et al. | |
| 5,867,857 | A | 2/1999 | Crouser et al. | |
| 5,870,798 | A | 2/1999 | Crouser et al. | |
| 6,009,594 | A | 1/2000 | Grey | |
| 6,134,746 | A | 10/2000 | Miller et al. | |
| 6,167,586 | B1 * | 1/2001 | Reed et al. | 15/320 |
| 6,243,912 | B1 | 6/2001 | Grey | |
| 6,286,181 | B1 | 9/2001 | Kasper et al. | |
| 6,363,570 | B2 * | 4/2002 | Kasper et al. | 15/320 |
| 6,640,386 | B2 | 11/2003 | Morgan et al. | |
| 6,842,942 | B2 * | 1/2005 | Morgan et al. | 15/414 |
| 7,159,271 | B2 * | 1/2007 | Sepke et al. | 15/320 |
| 2005/0102788 | A1 | 5/2005 | Pritts | |

* cited by examiner

*Primary Examiner*—Joseph J Hail, III
*Assistant Examiner*—Shantese McDonald
(74) *Attorney, Agent, or Firm*—Michael Best & Friedrich LLP

(57) ABSTRACT

A cleaning apparatus for cleaning a surface in which cleaning solution is dispensed to the surface and substantially simultaneously extracted along with the dirt on the surface in a continuous operation is provided. The cleaning apparatus includes a base portion for movement along the surface and a handle pivotally connected to the base portion. A solution tank for supplying a flow of cleaning solution to the surface is removably mounted to the handle. A recovery tank is removably mounted to the handle. A suction nozzle is secured to the base portion and in fluid communication with the recovery tank. A suction source is in fluid communication with the suction nozzle for generating suction to draw dirt and liquid through the suction nozzle and into the recovery tank. A cost effective, easy to operate, and convenient mounting arrangement is provided for mounting the recovery tank to the handle.

12 Claims, 31 Drawing Sheets

RECOVERY TANK ARRANGEMENT FOR A CLEANING APPARATUS

BACKGROUND OF THE INVENTION

1. Field of the Invention

The present invention relates to a recovery tank arrangement for a cleaning apparatus.

2. Background Information

It is known to have a carpet extractor for cleaning a surface such as a carpet in which cleaning solution is dispensed to the surface and substantially simultaneously extracted along with the dirt on the surface into a recovery tank in a continuous operation. Generally, the recovery tank is removably mounted to the handle or base of the carpet extractor. In the recovery tank, the liquid is separated from the working air. For relatively large recovery tanks of the canister style wet pickup suction cleaners, the liquid laden working air is allowed to expand and slow down upon entering the tank. This expansion and slowing of the working air is typically sufficient to adequately separate the liquid from the working air. However, recovery tanks for the upright carpet extractors or small floor cleaning units are generally small with little room. In these tanks, the liquid laden working air travels very fast, which makes it difficult for the liquid to expand and adequately separate from the air. Thus, it would be desirable to provide a recovery tank with a large capacity to improve the separation of the air from the liquid. Such a large recovery tank also increases the extractor's coverage of cleaning area before the recovery tank is full, thereby reducing the number of times the tank has to be emptied when cleaning a large area. However, a large tank requires more space on the extractor needed to mount it thereon. Thus, it would be desirable to provide a cost effective, easy to operate, and convenient mounting arrangement for mounting the recovery tank to the extractor that accommodates a large capacity tank.

SUMMARY OF THE INVENTION

The foregoing and other objects of the present invention will be readily apparent from the following description and the attached drawings. A cleaning apparatus for cleaning a surface in which cleaning solution is dispensed to the surface and substantially simultaneously extracted along with the dirt on the surface in a continuous operation is provided. The cleaning apparatus includes a base portion for movement along the surface and a handle pivotally connected to the base portion. A solution tank for supplying a flow of cleaning solution to the surface is removably mounted to one of the handle and base portion. A recovery tank is removably mounted to the handle and includes an upper portion. A suction nozzle secured to the base portion and in fluid communication with the recovery tank. A suction source is in fluid communication with the suction nozzle for generating suction to draw dirt and liquid through the suction nozzle and into the recovery tank. A pair of latches located on opposite sides of the upper portion of the recovery tank for releasably latching the recovery tank to the handle.

In another aspect of the invention, a cleaning apparatus for cleaning a surface in which cleaning solution is dispensed to the surface and substantially simultaneously extracted along with the dirt on the surface in a continuous operation is provided. The cleaning apparatus includes a base portion for movement along the surface and a handle pivotally connected to the base portion. A solution tank for supplying a flow of cleaning solution to the surface is removably mounted to one of the handle and base portion. A recovery tank is removably mounted to the handle and includes a lower portion having a recess. A suction nozzle secured to the base portion and in fluid communication with the recovery tank. A suction source is in fluid communication with the suction nozzle for generating suction to draw dirt and liquid through the suction nozzle and into the recovery tank. The handle includes a laterally extending support member that is received by the recess of the lower portion of the recovery tank for supporting the recovery tank upon the recovery tank being mounted to the handle.

In still another aspect of the invention, a cleaning apparatus for cleaning a surface in which cleaning solution is dispensed to the surface and substantially simultaneously extracted along with the dirt on the surface in a continuous operation is provided. The cleaning apparatus includes a base portion for movement along the surface and a handle pivotally connected to the base portion. A solution tank for supplying a flow of cleaning solution to the surface is removably mounted to one of the handle and base portion. A recovery tank is removably mounted to the handle. A suction nozzle secured to the base portion and in fluid communication with the recovery tank. A suction source is in fluid communication with the suction nozzle for generating suction to draw dirt and liquid through the suction nozzle and into the recovery tank. A latch is pivotally connected to the handle for releasably latching one of the solution tank and the recovery tank to the handle. The latch includes a first portion and a second portion, wherein depressing the first portion latches the one of the solution tank and the recovery tank to the handle and depressing the second portion of the latch unlatches the one of the solution tank and the recovery tank from the handle.

BRIEF DESCRIPTION OF THE DRAWINGS

The invention will now be described, by way of example, with reference to the attached drawings, of which:

FIG. 26 A is a view similar to FIG. 26, but showing the accessory hose assembly in the stretched position.

DETAILED DESCRIPTION OF THE INVENTION

Figure 1:
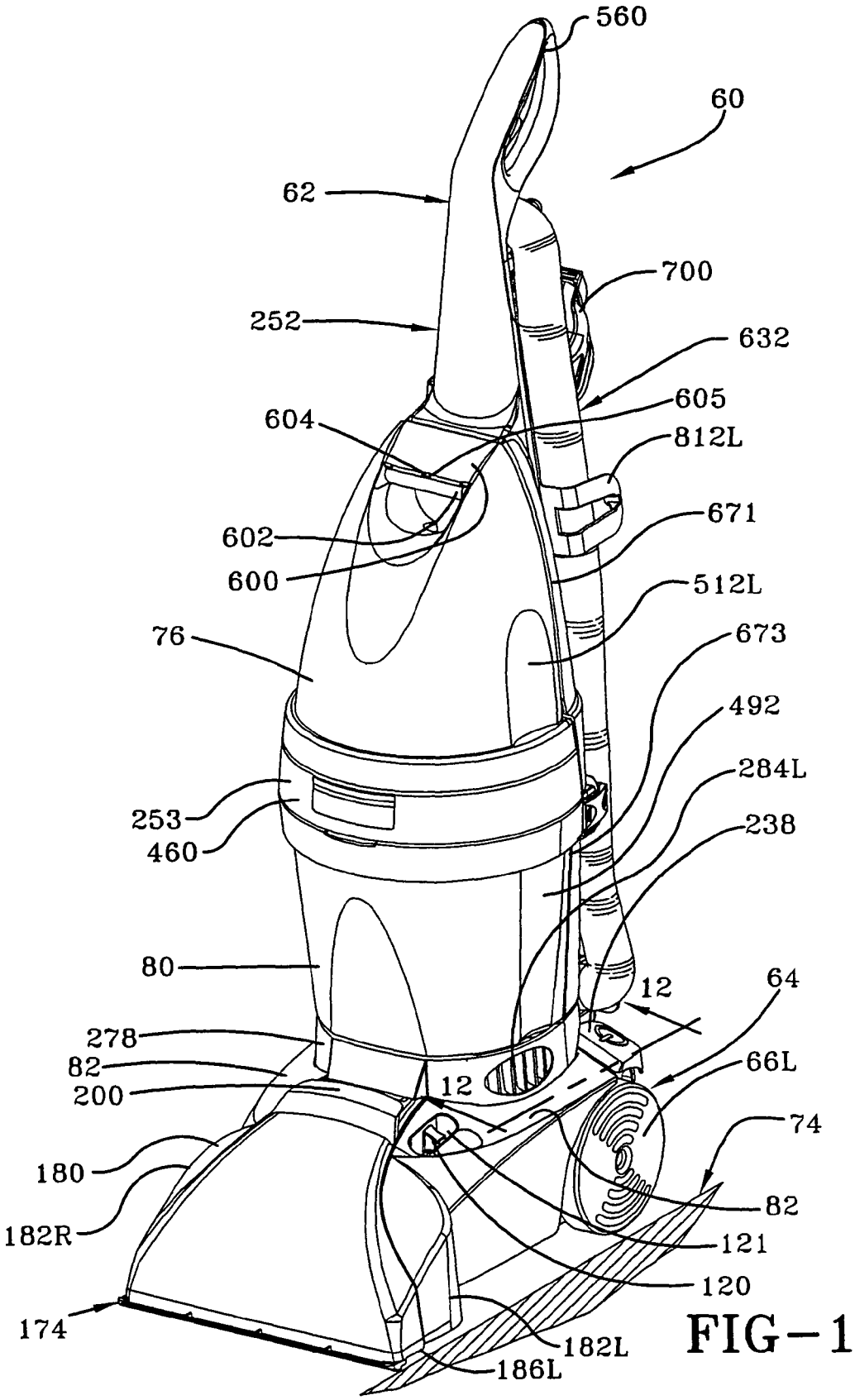
FIG. 1 is a perspective view of a carpet extractor embodying the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to the drawings, FIG. 1 depicts a perspective view of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet. The handle assembly 62 comprises an upper handle assembly 252 and a lower handle body shell 254 (FIG. 9) with a front body shell faceplate 253 (FIG. 9) mounted to it. The base assembly 64 includes a brush assembly 70 (FIGS. 2 and 4) having a plurality of rotating scrub brushes 72 for scrubbing the surface. A supply or solution tank 76 for holding cleaning solution is removably mounted to the handle assembly 62 of the extractor 60. A combined air/water separator and recovery tank 80 is removably mounted to handle assembly 62 below the solution tank 76 in a stacked arrangement.

Figure 2:
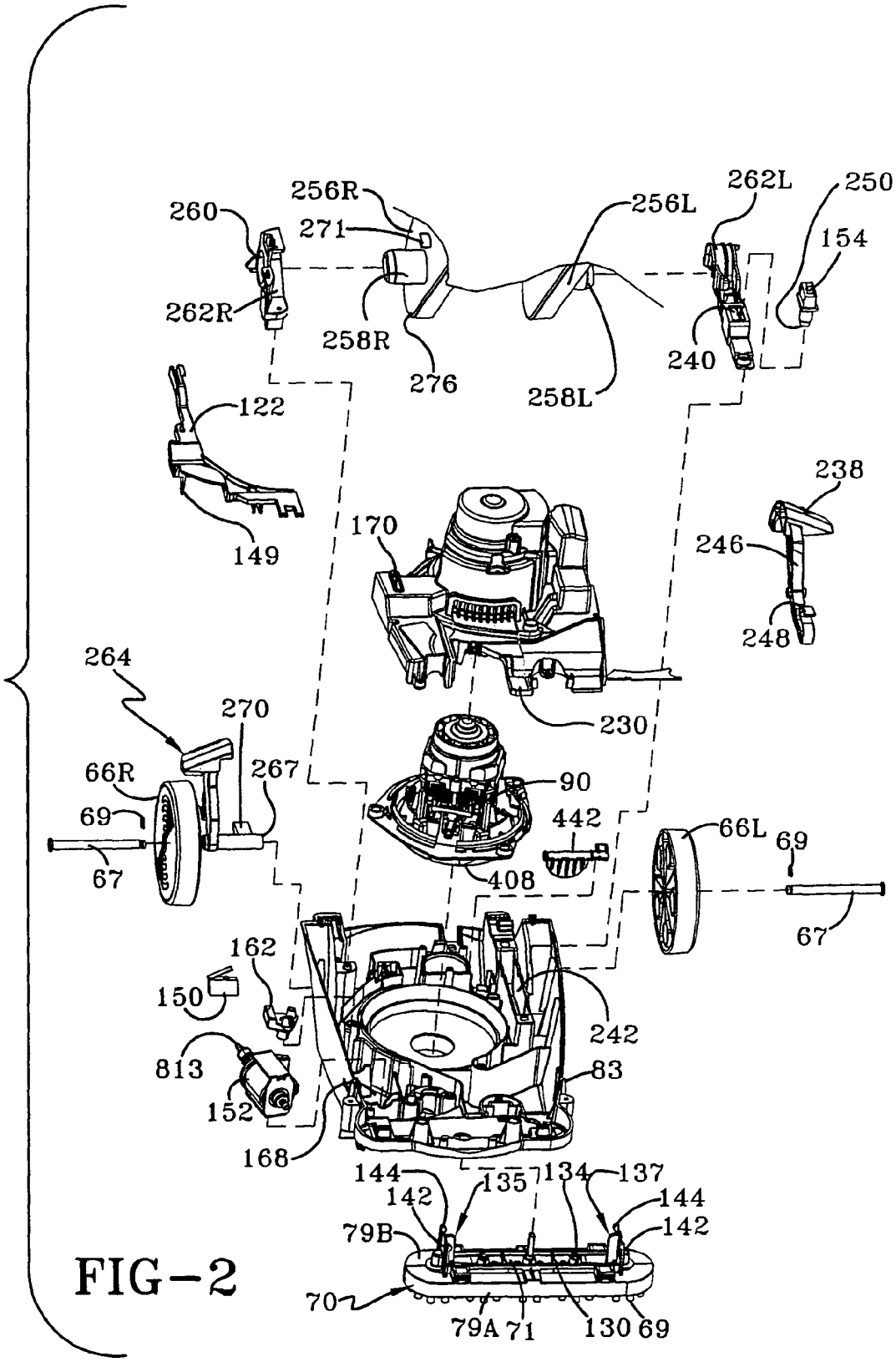
FIG. 2 is an exploded view of the lower portion of the base assembly and the lower portion of the handle with portions broken away therefrom of the carpet extractor of FIG. 1 illustrating the principle elements thereof.
Figure 5:
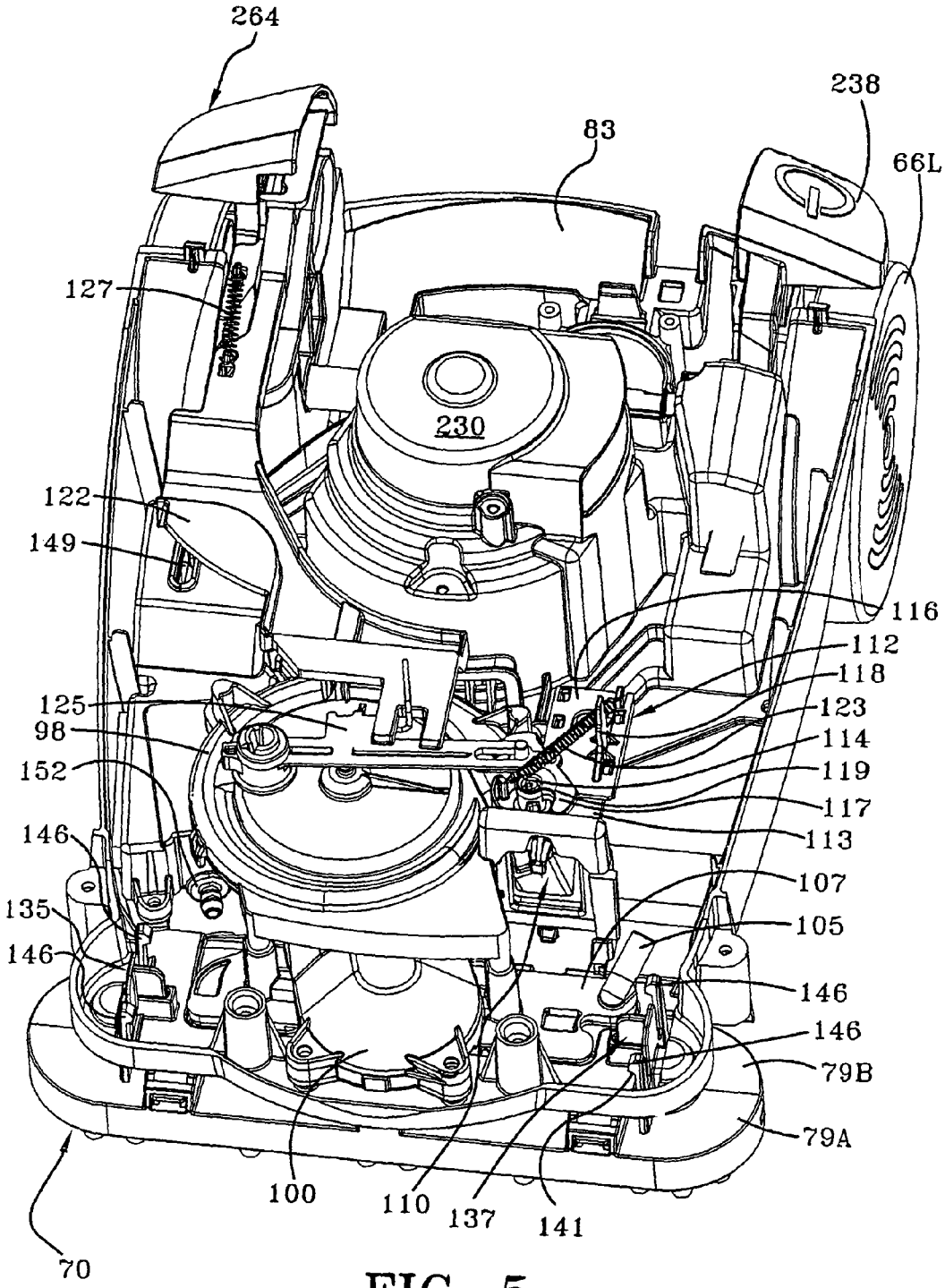
FIG. 5 is a perspective view of the lower portion of the base assembly of the carpet extractor of FIG. 1 illustrating the principle elements thereof.
Figure 8:
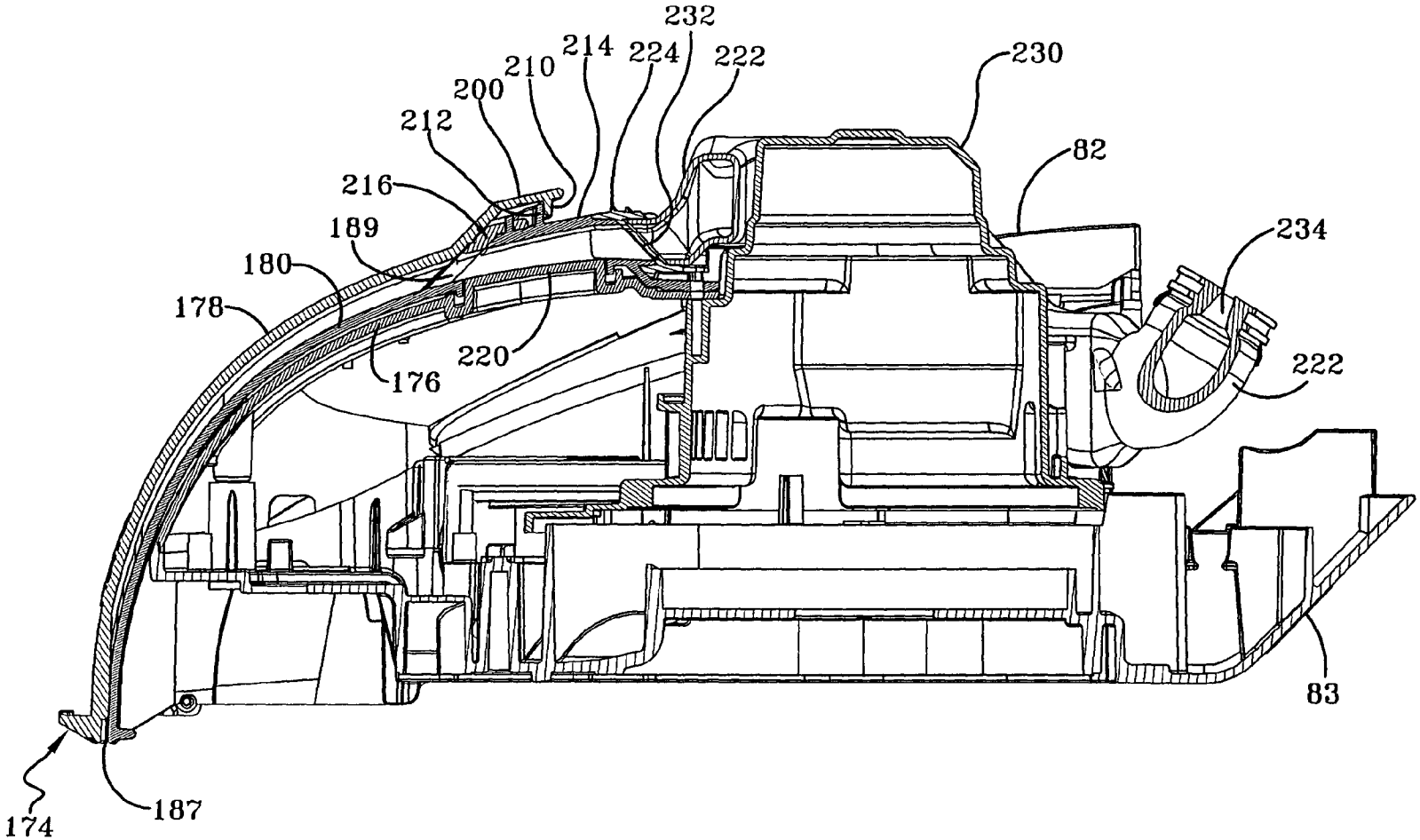
FIG. 8 is a partial side sectional view of the base assembly of the carpet extractor of FIG. 1, vertically taken through the center of the base assembly with the brush assembly and suction motor removed for illustrative purposes.

As depicted in FIG. 2, the base assembly 64 includes a generally unitary molded base frame 83 having two laterally displaced wheels 66L, 66R rotatably attached to the rear of the base frame 83 via axles 67. An e-ring 69 is secured to each axle 67 to prevent inadvertent removal of the axle from the frame. Integrally molded into the bottom of the base frame 83 is a circular stepped basin 86 (FIG. 20) receiving therein the motor/fan assembly 90 with motor cover 230. A suitable motor/fan assembly is shown in U.S. Pat. No. 5,500,977, the disclosure of which is incorporated by reference. An air driven turbine 98 providing motive power for the brush assembly 70 is mounted on the front portion of the frame 83 as seen in FIG. 5. The base assembly 64 further includes an upper housing or hood portion 82 (FIGS. 1 and 3) mounted atop the base frame 83 and air driven turbine 98. The top portion of motor/fan assembly 90, motor cover 230 and floor recovery duct 222 (FIG. 3) extends through a cutout or opening 282 (FIG. 3) in the hood portion 82 as seen in FIG. 8.

Figure 4:
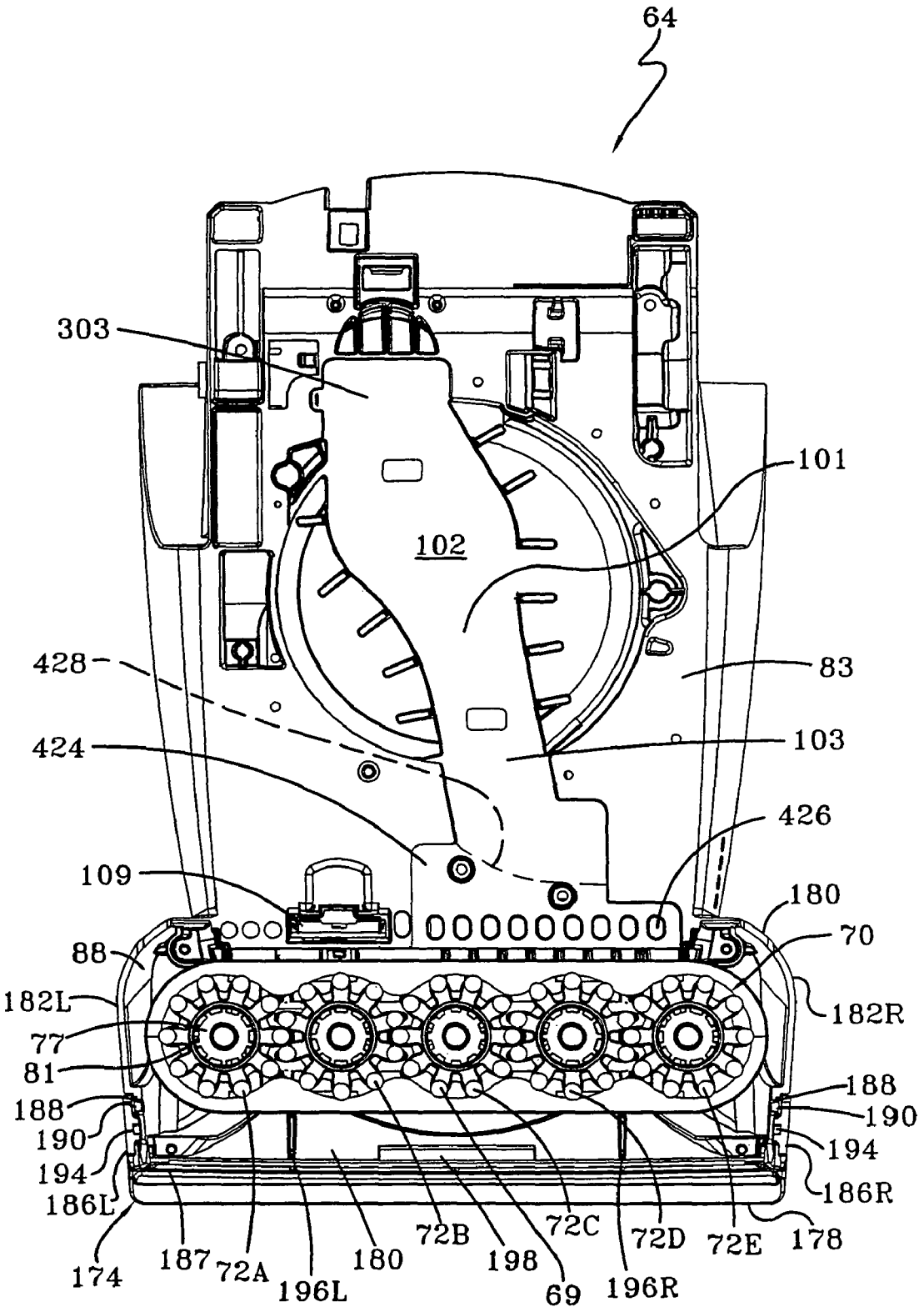
FIG. 4 is a bottom view of the base assembly of the extractor with the wheels removed for illustrative purposes.

As shown in FIGS. 2 and 4, the brush assembly 70 is contained in a brush assembly cavity 88 formed in the underside of the frame 83. The brush assembly 70 comprises a brush support beam 130 having five spaced apart integrally molded, cylindrical bearings 134. Rotatingly received within bearings are axial shafts (not shown but illustrated in previously mentioned U.S. Pat. No. 6,009,593; the disclosure of which is incorporated herein by reference) of gear brushes 72A, 72B, 72C, 72D, and 72E having bristles 69. The beam 130 further includes troughs 71, for receiving a cleaning solution. The cleaning solution flows through inlet 105 (FIG. 5) of distributor 107 (FIG. 5) to supply conduits of the beam 130 and then outward toward the surface being cleaned through openings 81 in the bottom of brush cups 77. Gear guards 79A and 79B are attached to the brush support beam 130 and are identical in construction so as to be interchangeable on either side of brush support beam 130.

Integral to and extending upward from the opposite lateral ends of brush support beam 130 are "T" shaped rails 135 and 137. As best seen in FIG. 5, T-rails 135 and 137 are slidably received within vertical guide slots 138 (FIG. 20) and 140 (FIG. 20) integrally molded into the lower base housing or frame 83 whereby brush assembly 70 may freely move or float in the vertical direction within the brush assembly cavity 88 of base assembly 64. Each T-rail includes front and rear hooks 142, 144 (FIG. 2) with inwardly extending noses 146 (FIG. 5) integrally molded on the upper portion of the hooks for removably mounting the brush assembly 70 to the frame 83. To mount the brush assembly 70 to frame 83, a user aligns the noses 146 of the hooks 142, 144 with the slots 138, 140 and pushes the brush assembly 70 towards the frame with sufficient force such that the noses 146 cam against the underside of the frame 83 at the inner edges of the slots 138, 140 and deflect outwardly so that they can extend through the slots. After extending through the slots 138, 140, the resilient noses 146 deflect back and engage the top surface of the frame 83 to secure the brush assembly 70 to the frame 83, when the base assembly 64 is lifted off the surface 74.

Each nose 146 of the hook members 142, 144 has an upwardly beveled bottom side 141 (FIG. 5) going from the inner end to the outer end that aids in removing the brush assembly 70. In particular, to remove the brush assembly 70, a user pulls down on the brush assembly with sufficient force to cause frame 83 to cam against the bevel bottom sides 141 of the noses 146 so as to deflect the noses 146 outwardly a sufficient distance to allow the hooks 142, 144 to fall through the slots 138, 140. Alternatively, a user can simply apply a lateral outward force on the hooks 142, 144 to disengage them from the frame 83.

Such a suitable brush assembly 70 with the exception of the previously described hooks used to mount the brush assembly to the frame 83 is taught in U.S. Pat. No. 5,867,857, the disclosure which is incorporated herein by reference. Brush assembly 70 is operated by a suitable gear train (or other known means), not shown, contained in transmission housing 100 (FIG. 5). A suitable air turbine driven gear train is taught in U.S. Pat. No. 5,443,362, the disclosure of which is incorporated by reference. The brush assembly 70 can be a horizontal brush roll driven by a belt secured to the suction motor or driven by a separate motor.

Referring now to FIG. 4, integrally molded into the underside of the frame assembly 83 is a vacuum manifold 102. Manifold 102 is completed by welding a bottom plate 101 to the bottom of the frame 83. The manifold 102 includes a conduit 103 in fluid communication with the turbine 98 (FIG. 5) that provides a vacuum source for the turbine 98. The motor fan assembly 90 generally provides suction to the manifold 102 through the eye of the fan. Atmospheric air, driving a brush turbine rotor enters by way of turbine inlet 110 (FIG. 5), passing through a screen 109 to filter out the dirt and then passing through the rotor. Positioned within inlet 110 is a throttle valve door 114 (FIG. 5) for energizing or de-energizing brush turbine rotor. Such a suitable brush turbine 98 is disclosed in U.S. Pat. No. 5,860,188 which is hereby incorporated by reference.

Referring now to FIG. 5, a manual override mechanism 112 is provided whereby the operator, operating in the floor-cleaning mode, may selectively close throttle valve 114 thereby de-energizing brush drive turbine 98. Alternatively, the operator may select an intermediate position whereby throttle valve 114 is partially closed thereby reducing the air flow through throttle valve 114 causing brush drive turbine 98 to rotate at a slower speed resulting in slower rotating brushes. Override mechanism 112 comprises a table 113 integrally molded to the body of brush drive turbine 98 and extending rearwardly having slide 116 slidingly attached thereto. Extending upwardly from slide 116 is lever arm 118 having a conveniently shaped finger cap 120 (FIG. 1) atop thereof. Lever arm 118 extends upward through a suitable opening (not shown) in the hood 82 whereby cap 120 is received within recess 121 in hood 82 as seen in FIG. 1.

Movement of the cap 120 (FIG. 1) in turn moves the slide 118 to rotating a bell crank 117, which in turn rotates the shaft of the valve 114, attached thereto. In particular, projecting upward from slide 116 is an arcuate rib 119. As slide 116 is moved rearward by the operator, the rib 119 engages the bell crank 117 rotating the bell crank 117 and throttle valve 114 counterclockwise thereby closing throttle valve 114 and de-energizing the brush drive turbine 98. Upon return of the slide 116 to its original position (as illustrated in FIG. 5), a spring 123, secured between the bell crank 117 and the slide 116, causes the bell crank 117 to rotate clockwise, thereby rotating throttle valve 114 to the full open position. Generally as the slide 116 moves from one position to the other, a cantilevered tab releasingly engages concavities in the surface of the table, which corresponds to the open and close position of valve 114. A similar mechanism is disclosed in U.S. Pat. No. 5,860,188, the disclosure of which is incorporated by reference.

Figure 13A:
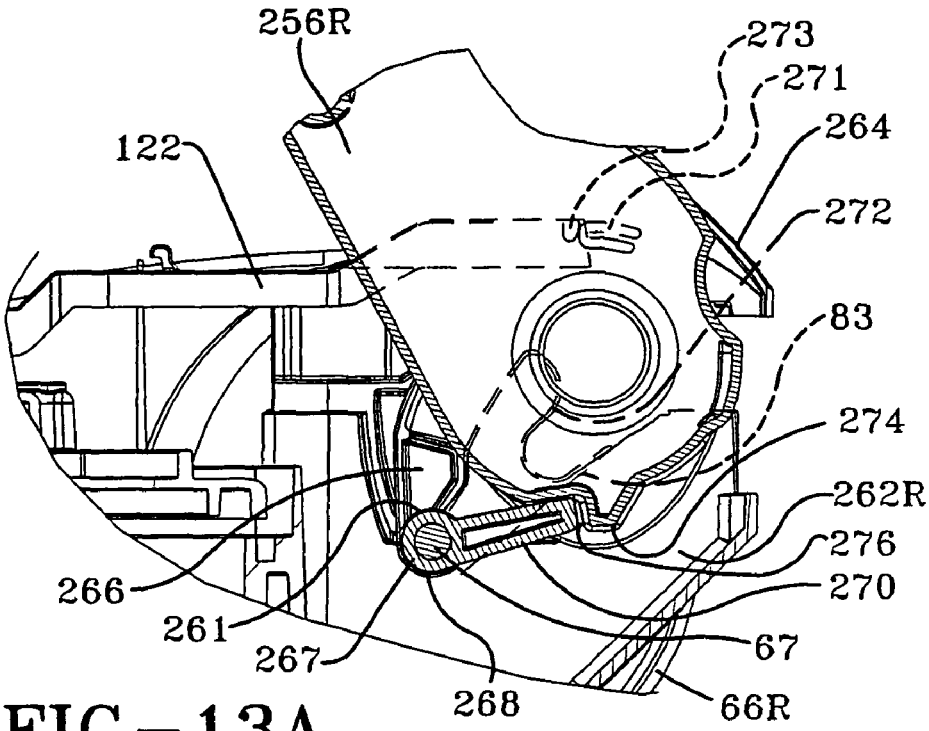
FIG. 13A is a partial sectional view taken along line 13A-13A of FIG. 11.

Further, when the handle assembly 62 is pivoted in the upright storage position, an actuating rod 122 links with the bell crank 117 via linking member 125 to turn the brushes off. In particular, as shown in FIG. 13A, a cam projection 271 formed on the outer surface of a right extension 256R of the handle assembly 62 cams against a rib 273 formed on the actuating rod 122 to cause the actuating rod 122 to close the throttle valve door 114 and turn the brushes off. However, when the handle assembly 62 is pivoted down to the incline working position, the cam projection 271 disengages from the rib 273, thereby allowing a spring 127, secured between the actuating rod 122 and trunnion bracket 262R, to urge the actuating rod 122 rearwardly to the position of FIG. 13B, which opens the throttle valve door 114 and turns on the brushes. Further details of this arrangement are disclosed by U.S. Pat. No. 5,983,442, the disclosure of which is hereby incorporated by reference. Alternately, the speed of the brush assembly 70 could be controlled by controlled in response to a control signal from the CPU 845 (See FIG. 21A).

Figure 6:
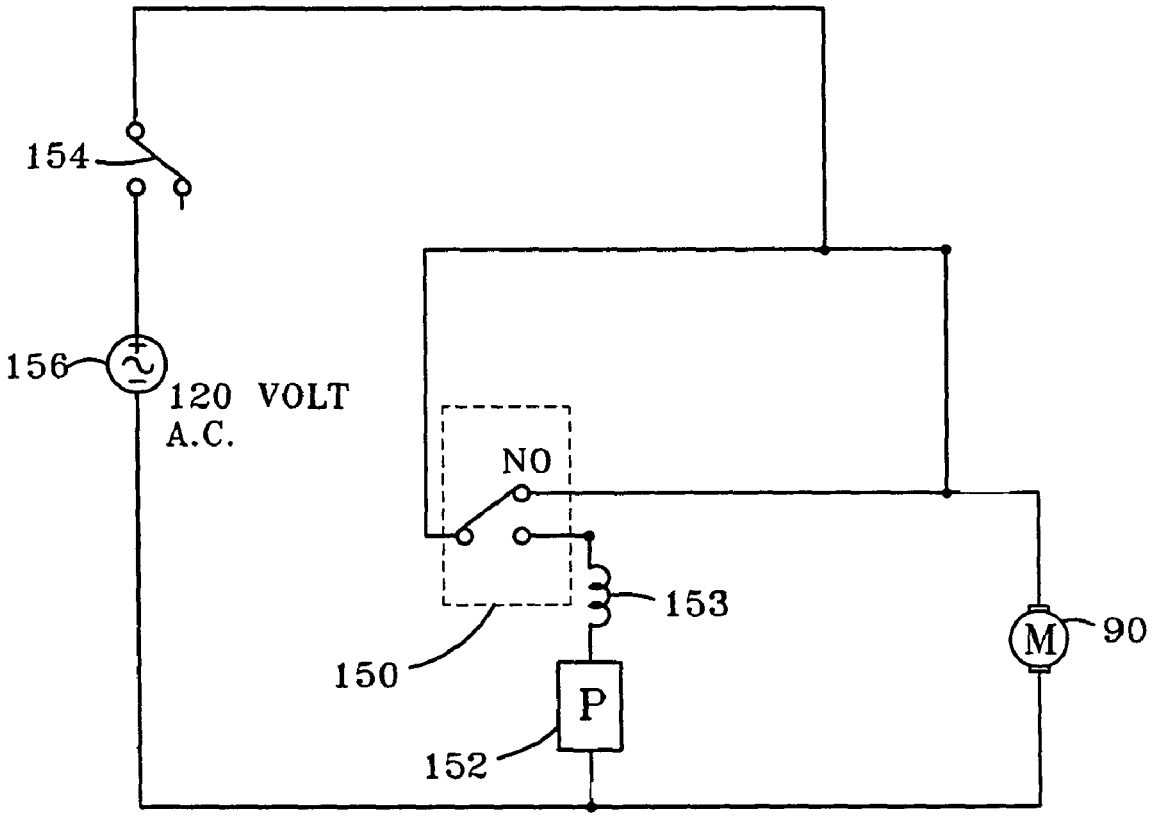
FIG. 6 is a schematic diagram showing the electrical circuit for the suction motor and pump used in the embodiment shown in FIG. 1.
Figure 7:
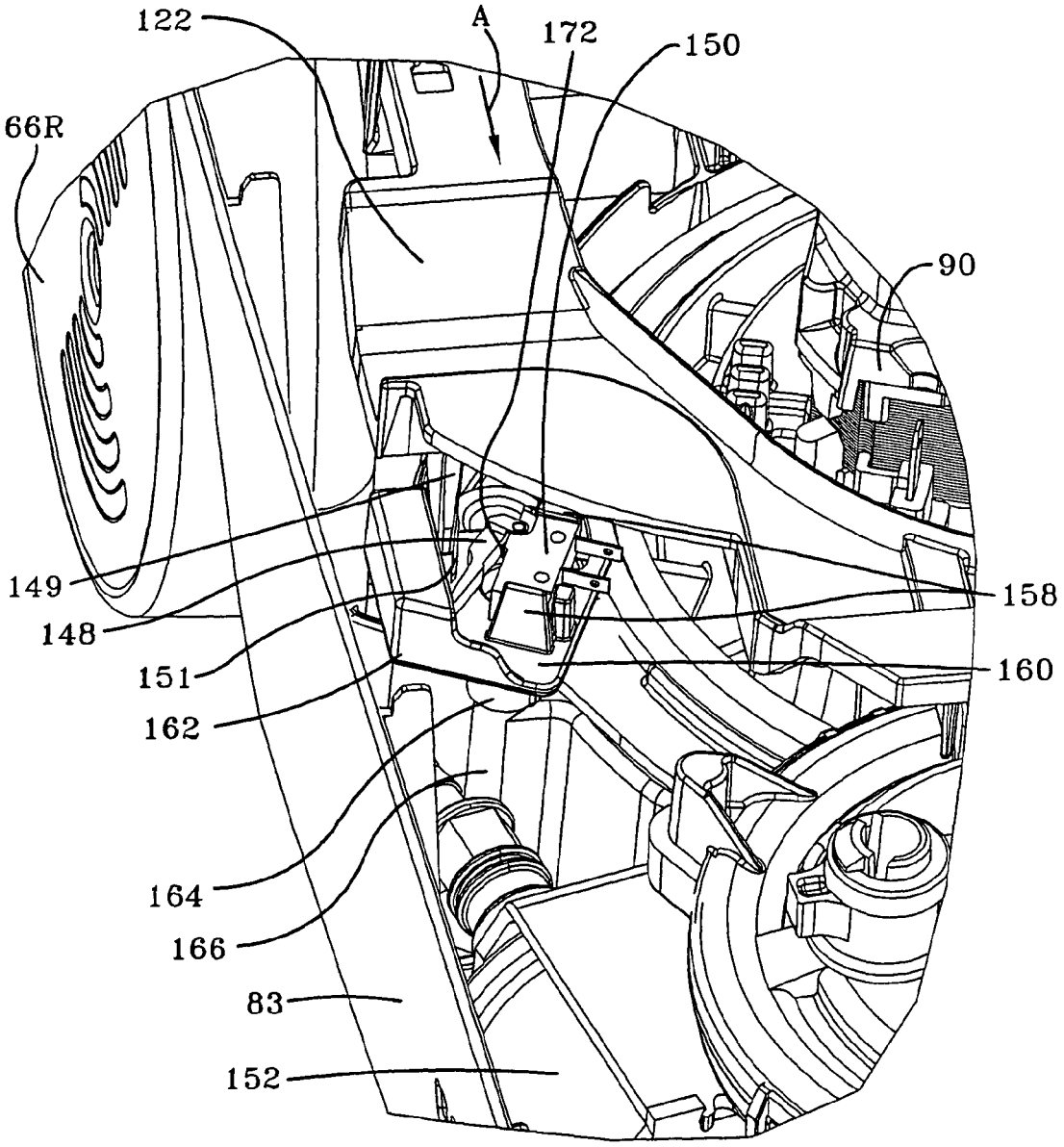
FIG. 7 is a front, side, and top partial perspective view of the lower portion of the base assembly shown in FIG. 5 with the motor cover removed for illustrative purposes.

Turning to FIG. 7, the actuating rod 122 further has a downwardly depending cam projection 149 that cams against a lever 148 of a microswitch 150 to turn on a solenoid pump 152 when the handle assembly 62 is in the upright position and main power switch 154 (FIG. 6) is on for upholstery or above the floor cleaning using the accessory hose. In particular, as seen in FIG. 6, the microswitch 150 is electrically coupled between solenoid 153 of the pump 152 and a power source 156 such as household current. Referring to FIG. 7, the microswitch 150 is captured by clips 158, which are integrally molded to a table 160 of a holder 162, which is mounted to the right side of the frame 83 adjacent the suction motor assembly 90. The holder 162 includes a tubular support boss 164 depending downwardly from the table 160 that telescopingly receives an upwardly extending post 166 integrally molded to the frame 83. As seen in FIGS. 2 and 5, the pump 152 is mounted in a compartment 168 of the frame 83 forwardly adjacent the microswitch 150. The holder 162, microswitch 150, and pump 152 are covered by the motor cover 230. The cam projection 149 of the actuating rod 122 extends into a slot 170 formed in the motor cover 230 for guiding the projection 149 to the lever 148 of the microswitch 150.

As best seen in FIG. 7, the microswitch 150 includes a spring-loaded pushbutton 172 aligned underneath the lever 148. The microswitch 150 is normally open as seen in FIG. 6. When the handle assembly 62 is moved to the upright position, the cam projection 149 moves forward as indicated by the arrow A, guided by guide projection 151, and cams against the lever 148, which pushes the pushbutton 172 to close or complete the circuit between the power source 156 and pump 152, thereby energizing the solenoid 153 (FIG. 6) to turn on the pump 152. When the handle assembly 62 is in the inclined or working position, the cam projection 149 is disengaged from the lever 148, thereby allowing the pushbutton 172 to extend, which opens the circuit between the power source 156 and pump 152 thereby turning off the pump 152. The pump 152 is designed and constructed to provide enough pressure to draw the cleaning solution to spray mechanism of accessory hose. Alternatively, other types of pumps can be used such as, for example, a centrifugal pump, gear pump, or air driven turbine pump. Moreover, the solenoid pump 152 could be activated in response to a control signal generated by a CPU 845 in response to a sensor 841 detecting the removal of a free end 638 of the accessory hose 632 from the holster 618 (As shown in FIG. 21A).

Turning to FIGS. 1, 3, 4 and 8, a floor suction nozzle assembly 174 is mounted to a depressed zone 176 (FIG. 3) on the hood portion 82 of the base assembly 64. In particular, as seen in FIG. 8, the floor suction nozzle assembly 174 includes a translucent front plate 178 removably mounted to a rear plate 180 to form a flowpath going from its inlet 187 to outlet 189. The rear plate 180 is fixedly mounted to the depressed zone 176 by any suitable mounting means such as, for example, screws. As seen in FIG. 4, integrally molded on the underside of the rear plate are stiffening ribs 196R, 196L oriented longitudinally with respect to the base assembly 64, and a stiffening rib 198 oriented transverse to base assembly 64. The rear plate 180 includes integrally molded opposite side portions 182R, 182L, which extend rearwardly from the front of the rear nozzle plate 180. The side portions 182 are located outwardly adjacent the brush assembly 70 and extend over or cover the side ends of the brush assembly 70. Optionally, the side portions 182 can be translucent such that the brush assembly 70 can be viewed through them as seen in FIG. 1. Alternatively, the rear plate and hood can be translucent so that the brush assembly can be view through them, or alternatively, the rear plate and hood can have front transparent window portions so that the brush can be viewed through them.

Each side portion 182 includes a recessed portion 184 (FIG. 3) that receives complementary side portions 186R, 186L of the front plate 178 to aid in retaining the front plate 178 to the rear plate 180, while also providing a relatively smooth appearance due to the front plate 178 being flushed with the rear plate 180. As best seen in FIG. 4, a groove 188 is formed in the bottom edge 192 (FIG. 3) of the recessed portion 184 for receiving a lateral inwardly extending projection 190 integrally molded on the corresponding side portion 186 of the front plate 178. Each side portion 186 of the front plate 178 also has an inwardly extending rib 194 spaced forwardly of the projection 190 that abuts the bottom edge 192 (FIG. 3) of the side portion of the rear plate 180, which prevents the front plate 178 from pivoting down to the surface 74.

As depicted in FIG. 8, the upper or rear end of the front nozzle plate 178 defines a tab or hand grip 200 that has a downward depending rib or stop member 210, which catches behind a raised portion 212 on the rear or upper portion 214 of the rear nozzle plate 180 to secure the front nozzle plate 178 to the rear nozzle plate 180. To remove the front nozzle plate 178, a user grasps the hand grip 200 and pulls upward to disengage the stop member 210 from the raised portion 212 and then slides the front nozzle plate 178 down to unseat the projection 190 (FIG. 4) from the groove 188 (FIG. 4). The front nozzle plate 178 then can be slid forward and removed. A rubber rope seal 216 is sandwiched between the front and rear nozzle plates 178, 180 to prevent fluid leakage. A plurality of flow ribs 179 are integrally molded to the underside of the front nozzle plate 178 and extend down to the rear nozzle plate, when the front nozzle pate 178 is mounted to the rear nozzle plate 180. The flow ribs 179 slow down the flow of liquid laden air impinging upon them, thereby aiding separation of the air from the liquid. The flow ribs 179 further produce a more uniform distribution of suction across the suction inlet 187.

Figure 9:
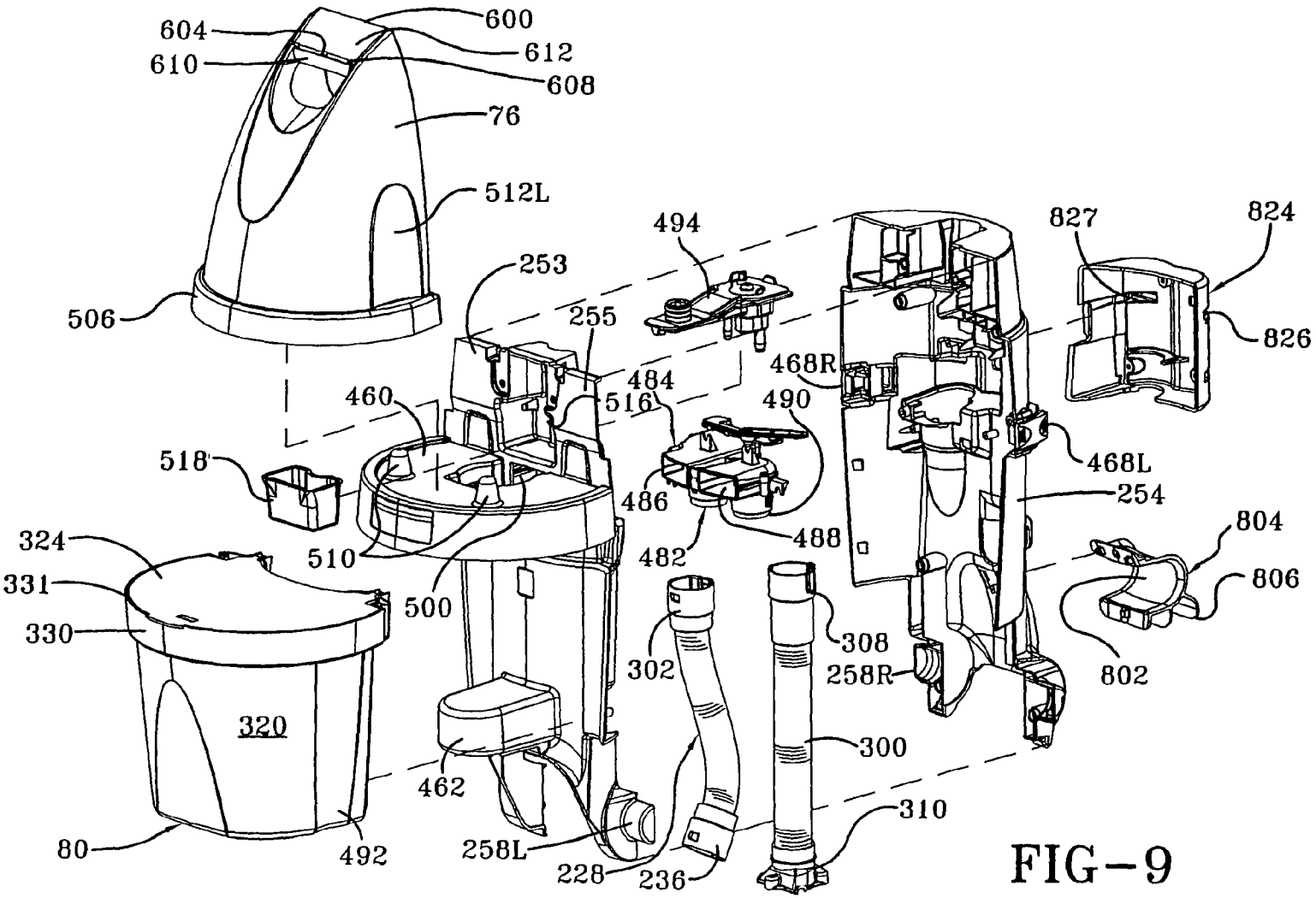
FIG. 9 is an exploded view of the lower portion of the handle assembly of the carpet extractor of FIG. 1.

The outlet 189 of suction nozzle assembly 174 is fluidly connected to an inlet 218 (FIG. 3) of a working air conduit, which is formed by the upper portion 214 of the rear nozzle plate 180 and the upper portion 220 of the depressed zone 176. The upper portion 220 is raised so as to be flushed with the rear nozzle plate 180 and includes a seal 226 (FIG. 3) secured therearound. The conduit is fluidly connected to an inlet 232 of a unitary, plastic, floor recovery duct 222. The floor recovery duct 222 is mounted to the motor cover 230. A seal 224 is secured around the connecting area of the conduit and floor recovery duct 222 to prevent fluid leakage. A corrugated flexible floor recovery hose 228 (FIG. 9) is fluidly connected to the outlet 234 of the floor recovery duct 222 via a sleeve connector 236 (FIG. 9).

Figure 12:
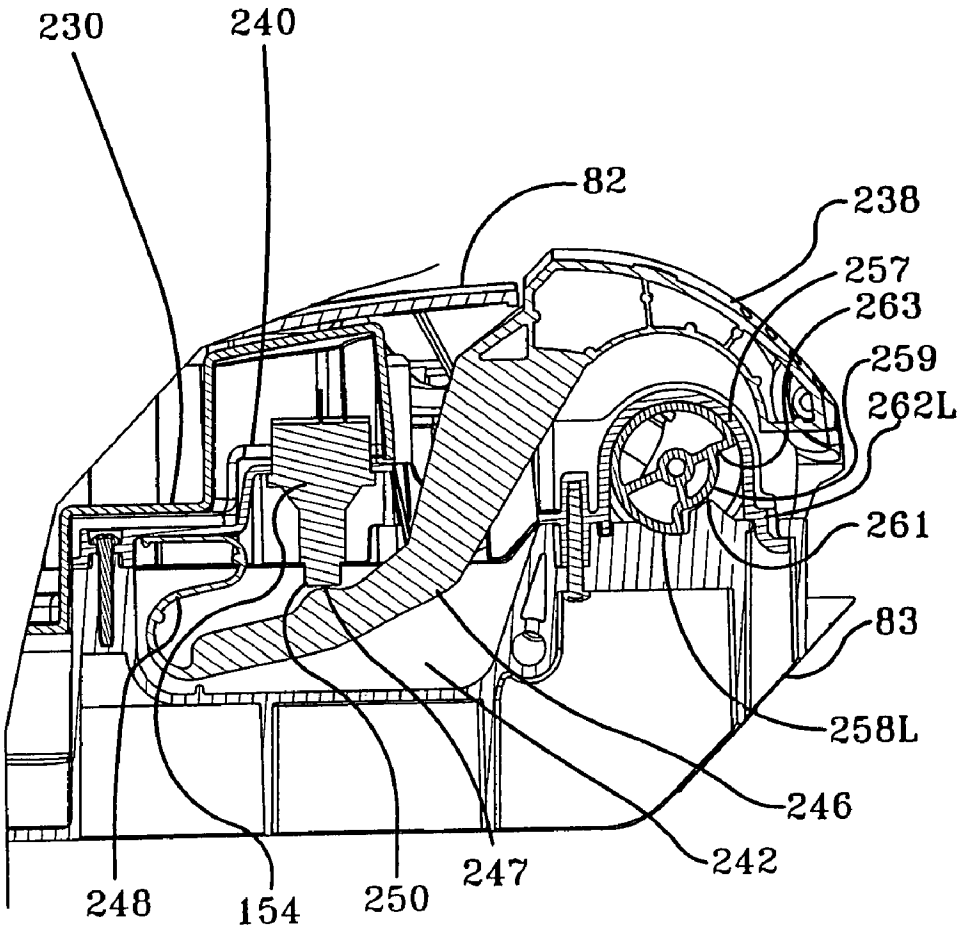
FIG. 12 is a partial sectional view taken along line 12-12 of FIG. 1 with the brush assembly removed.

As best seen in FIGS. 2 and 12, the base assembly 64 further comprises a pedal 238 that operates the on/off power switch 154. The switch 154 is a push-push type power switch, which is mounted in a pocket 242 of the frame 83 by an elongated holder 240 extending laterally from trunnion bracket or retainer 262L. The pedal 238 is generally triangular shaped sloping and converging rearwardly and downwardly as best seen in FIG. 1. An integrally molded lateral leg 246 extends forwardly from the pedal 238 and terminates into an s-shaped spring arm 248. As seen in FIG. 12, the spring arm 248 bears against the upper wall of the holder 240 to bias the leg 246 down so that cam projection 247 of the leg 246 does not press against the push button 250 of the power switch 154. Pushing downwardly on the pedal 238 with sufficient force to overcome the elastic force of the spring arm 248 causes the cam projection 247 to push the push button 250 which causes the power switch 154 to close the circuit (FIG. 6) between the power source 156 and suction motor 90 and also between the power source 156 and pump 152 (if the handle assembly 64 is in the upright position), thereby turning on the suction motor 90 and pump 152. When the pedal 238 is released, the spring arm 248 urges the leg 246 down to allow the push button 250 to extend. The push button 250 is now in a position to open the circuit between the power source 156 and suction motor 90 upon being depressed. Thus, pushing the pedal 238 again causes the cam projection 247 to push the push button 250 and turn off the suction motor 90 and also power to the pump 152 (if the handle is in the upright position).

Referring to FIG. 2, the lower portions of the lower body shell 254 (FIG. 9) and a front body shell face plate 253 (FIG. 9) of the handle assembly 62 together form a pair of opposite side extensions 256L, 256R depending downwardly therefrom. The side extensions 256 have integral trunnions 258L, 258R. The right trunnion 258R is pivotally received in an aperture 260 through right trunnion bracket or retainer 262R, which is mounted to the rear of the frame 83. The left trunnion 258L is pivotally mounted on the rear of the frame 83 by a left trunnion bracket or retainer 262L, which has an arcuate portion 257 (FIG. 12) covering the left trunnion 258L. In essence, the trunnion brackets 262L, 262R are mounted over the trunnions to cover them, thereby pivotally securing the handle assembly 62 to the base 64. As seen in FIG. 12, the left trunnion 258L has a notch 259 that receives a stop projection 261 on the frame. If the handle assembly 62 is pivoted down too far, the rear end 263 of the notch strikes the stop, thereby preventing further pivoting of the handle assembly 62.

Figure 10:
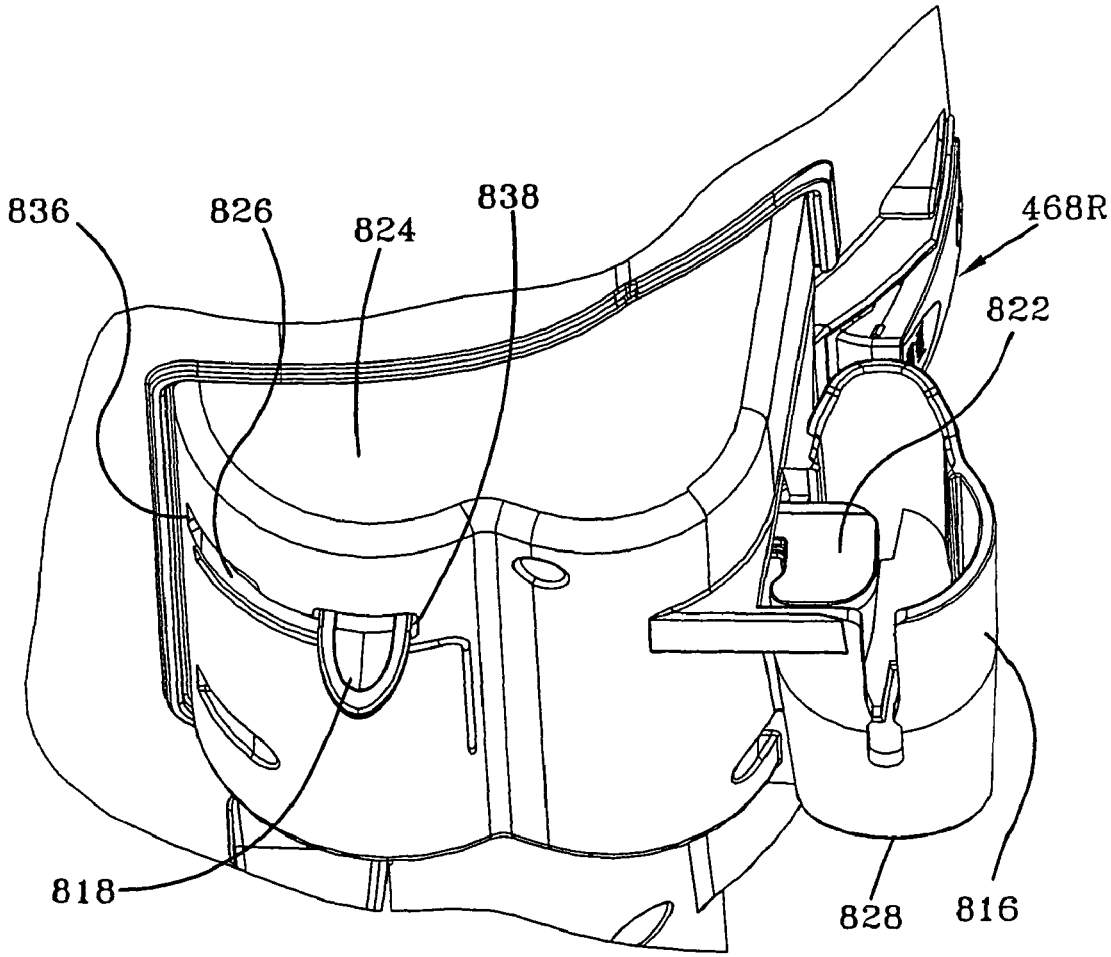
FIG. 10 is a fragmentary rear perspective view of the carpet extractor of FIG. 1 showing the conversion valve assembly and related elements.
Figure 11:
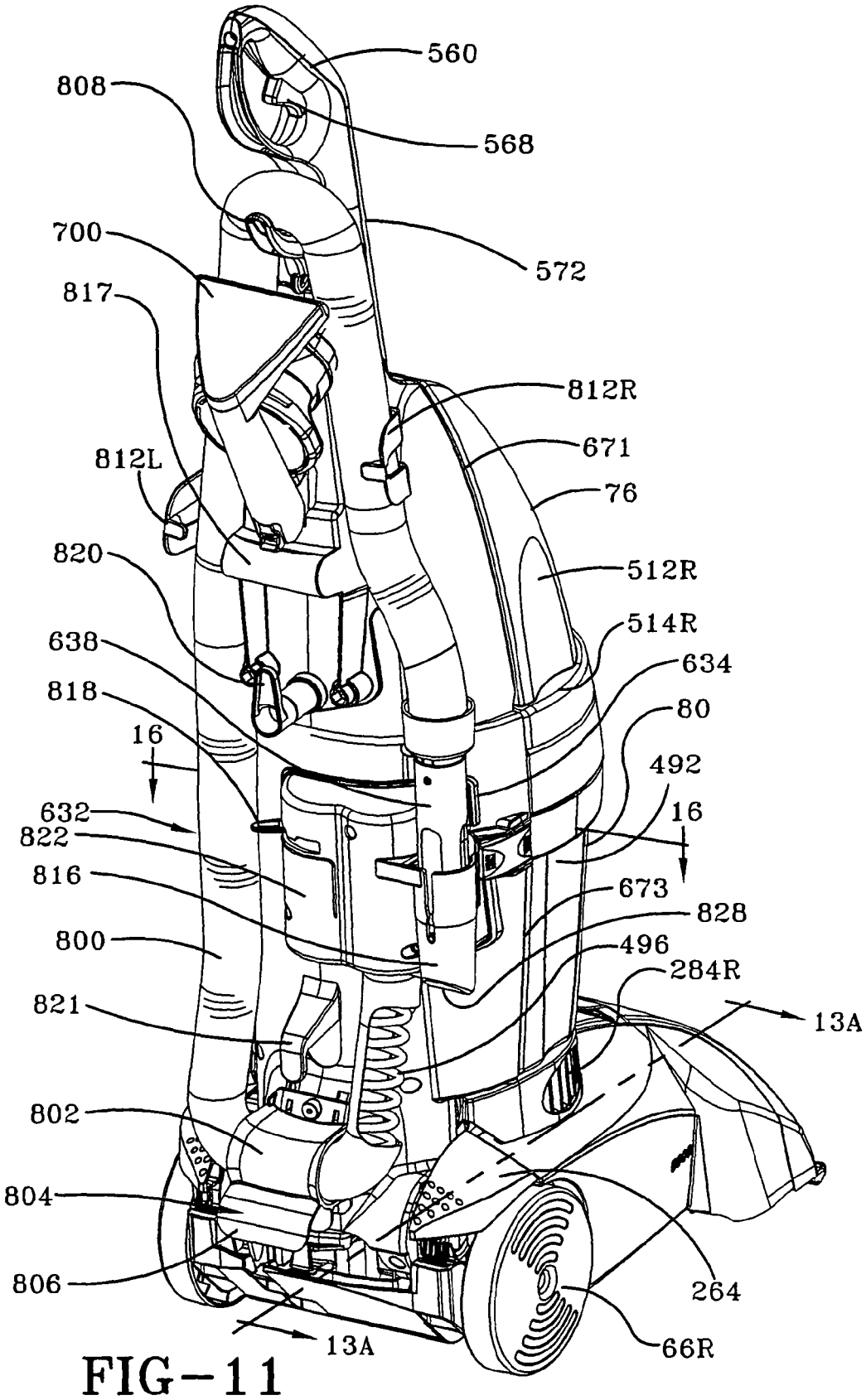
FIG. 11 is rear and right side perspective view of the carpet extractor of FIG. 1 with the accessory hose assembly on the caddy.
Figure 13B:
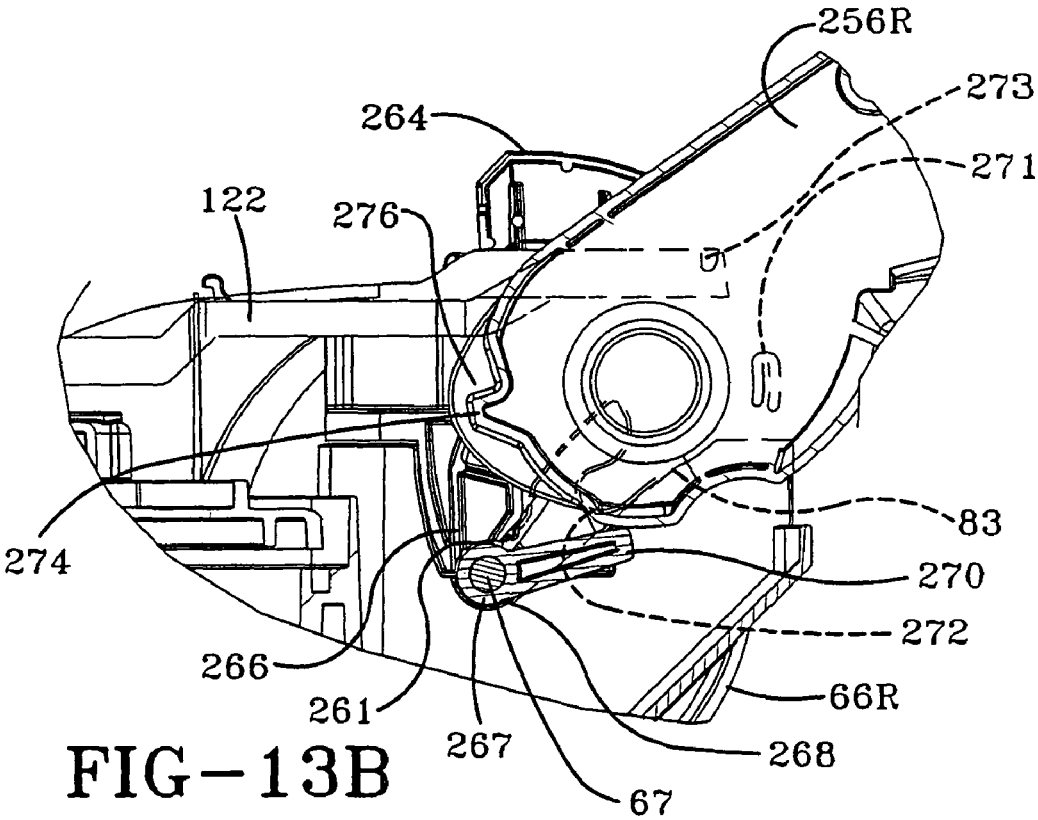
FIG. 13B is a view similar to FIG. 13A except that the handle assembly is in the inclined use position.

A handle release pedal 264 is pivotally connected to the axle 67 of the right wheel 66R as seen in FIGS. 2, 11, 13A and 13B. The pedal 264 is generally triangular shaped sloping and converging rearwardly and downwardly as seen in FIGS. 10 and 11. As depicted in FIGS. 13A and 13B, a leg 266, integrally molded to the pedal 264, extends forwardly therefrom. An elongated hollow pivot rod 267 is attached at its outer end to the leg 266 and extends inwardly, telescopingly receiving the axle of the right wheel 66R. The rod 267 is seated in an arcuate surface 268 of the frame 83 and is covered by an arcuate surface 261 of the trunnion bracket 262R. A finger 270 is integrally formed with the rod 267 and extends rearwardly. An s-shaped spring arm 272, integrally formed with the leg 266 and spaced rearwardly from the leg 266, extends downwardly and bears against the frame 83.

As depicted in FIG. 13A, the spring arm 272 urges the finger 270 upwardly such that it is positioned forwardly adjacent a stop 274, integrally formed on the outer surface of the right extension 256R of the lower handle body 254. The finger 270 is also positioned in between integral guide walls 276 extending forwardly from the stop 274 to align the finger 270 with the stop 274. In this position, the finger 270 engages the stop 274 thereby preventing the handle assembly 62 from pivoting down. However, when the pedal 264 is depressed, the elastic spring arm 272 bends to allow the finger 270 to pivot down and away from the stop 274 and thus, the handle assembly 62 is permitted to pivot down as seen in FIG. 13B.

Figure 3:
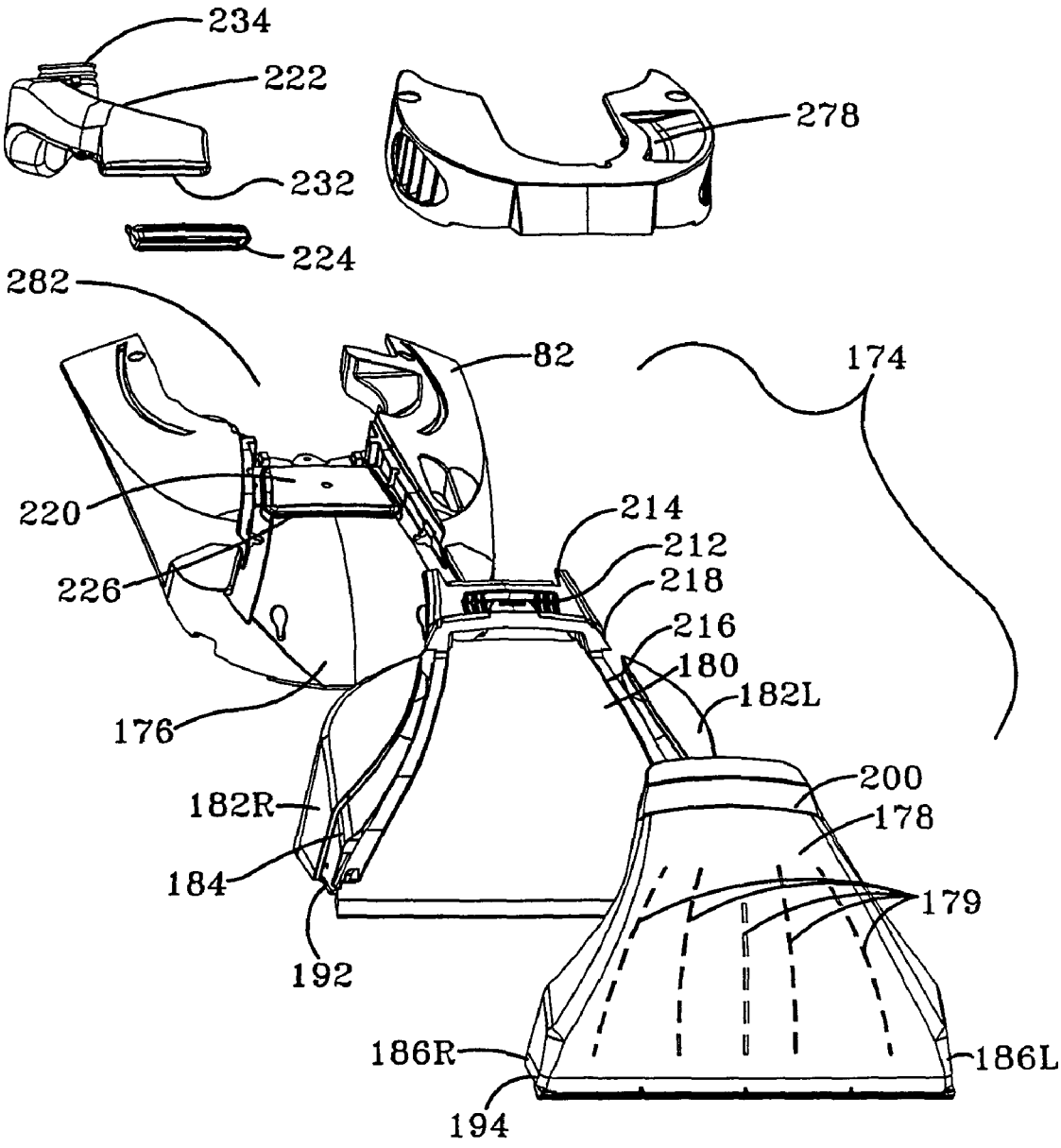
FIG. 3 is an exploded view of the upper portion of the base assembly illustrating the principal elements thereof.

Referring to FIG. 3, a shroud 278 is mounted on the hood 82 and motor cover 230 and surrounds the exposed top portion of the motor cover 230 and floor recovery duct 222. When the handle assembly 62 is in the upright position as seen in FIG. 1, the recovery tank 80 is positioned upon or spaced slightly above the shroud 278 to cover the top portion of the motor cover 230 and floor recovery duct 222. The shroud 278 includes left and right symmetrical vent portions 284L, 284R formed on its opposite sides for venting the motor cooling air entering and exiting the suction motor 80, when the handle assembly 62 is in the upright position.

As depicted in FIG. 9, a lateral tongue 462 is integrally molded to the front body shell faceplate 253 and extends forwardly to support the recovery tank 80. Specifically, the recovery tank 80 includes a complementary rear recess 464 (FIG. 15) formed on the underside of bottom wall 318 that slidably receives and rests upon the tongue 462, when the recovery tank 80 is mounted to the tongue 462 and face plate 253. The tongue 462 also guides the recovery tank to the faceplate 253 and in combination with the recess 464 laterally supports the tank from side to side, thereby preventing or substantially minimizing side by side movement of the recovery tank 80. Since the tongue 462 is a smaller support member than the commonly used platform or shelf, it is more cost effective and also allows more room on the handle assembly 62 to accommodate a larger size recovery tank 80.

Figure 16:
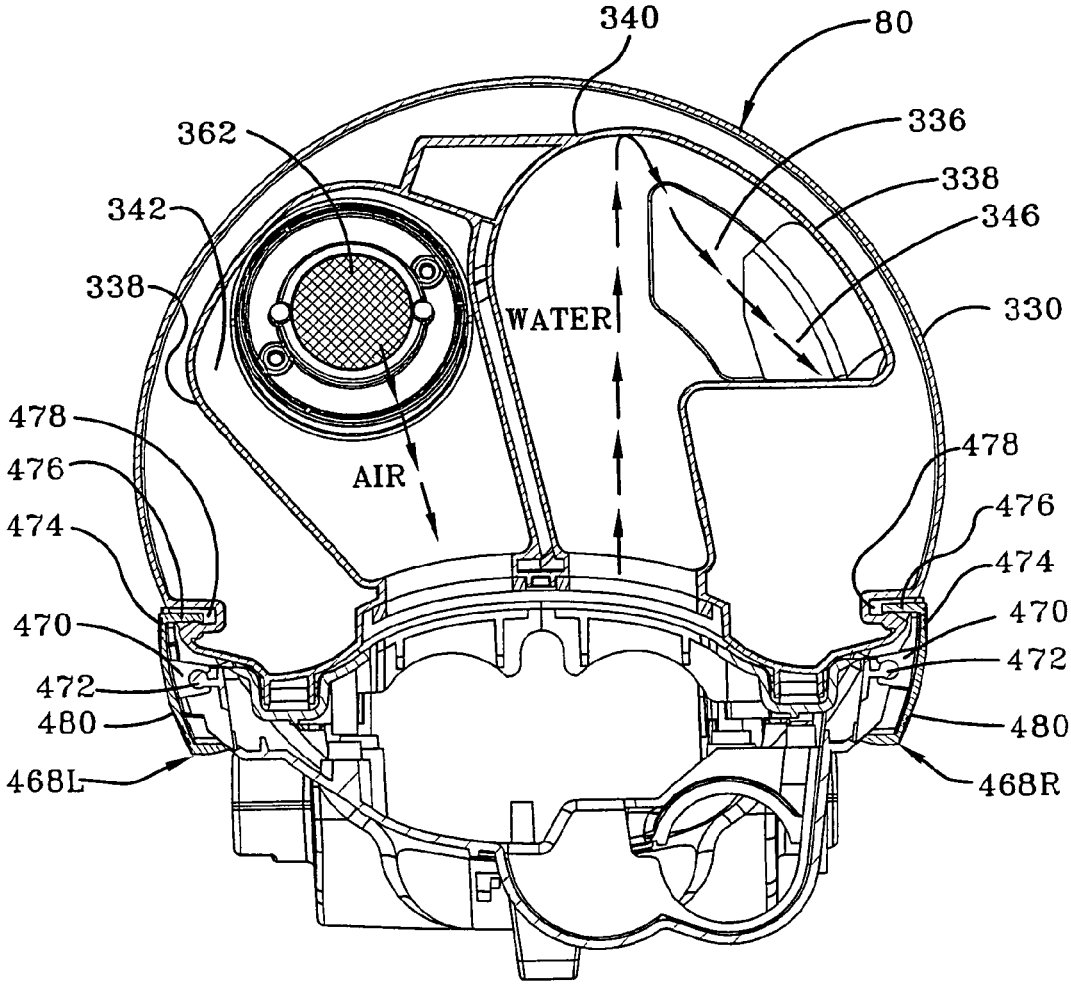
FIG. 16 is a partial sectional view along lines 16-16 of FIG. 11 with the accessory hose assembly and base assembly removed for illustrative purposes.

A pair of latches 468L, 468R releasably latches the recovery tank 80 to the handle assembly 62. In particular, as seen in FIG. 16, each of the latches 468 include upper and lower clips 470 formed at the center of the latch 468 that snap onto and pivotally receive a pin 472 integrally molded on the lower body shell 254. The front end of each of the latches 468 defines an inwardly curved tang 476 that is inserted into a corresponding notch 478 formed in flange 330 of top wall 322 of the recovery tank 80, upon depression of the front portion 474 of the latch 468. To disengage the tang 476, from the notch 478, a user depresses the rear portion 480 of the latch 468 to pivotally move the tang 476 outwardly away from the notch 478. Thus, when the tangs 476 of both latches 468 are disengaged from their respective notches 478, the recovery tank 80 can be easily slidably removed from the handle assembly 62 without the need to pivot or additionally manipulate the recovery tank 80 from the handle assembly 62.

Referring back to FIG. 9, the floor recovery hose 228 is captured between the faceplate 253 and lower body shell 254 and fluidly connected to a vertical floor inlet 482 of a conversion valve assembly 484 via sleeve connector 302. The conversion valve assembly 484 is in fluid communication upstream with the recovery tank 80 via horizontal entrance passageway 486. The conversion valve assembly 484 is in fluid communication downstream with the recovery tank 80 via the exit passageway 488, when the recovery tank 80 is mounted to the handle assembly 62. A corrugated air exhaust hose 300 is captured between the faceplate 253 and lower body shell 254 and fluidly connected to outlet 490 of the conversion valve assembly 484 via a sleeve connector 308. Each of the sleeve connectors 236, 302, 308 use a male and female snap type connection to their respective elements 234, 482, 490. Also, the sleeve connectors 236, 302, 308 are encapsulated to the ends of the hoses 228, 300 as the connectors 302, 308 are being molded.

Figure 19A:
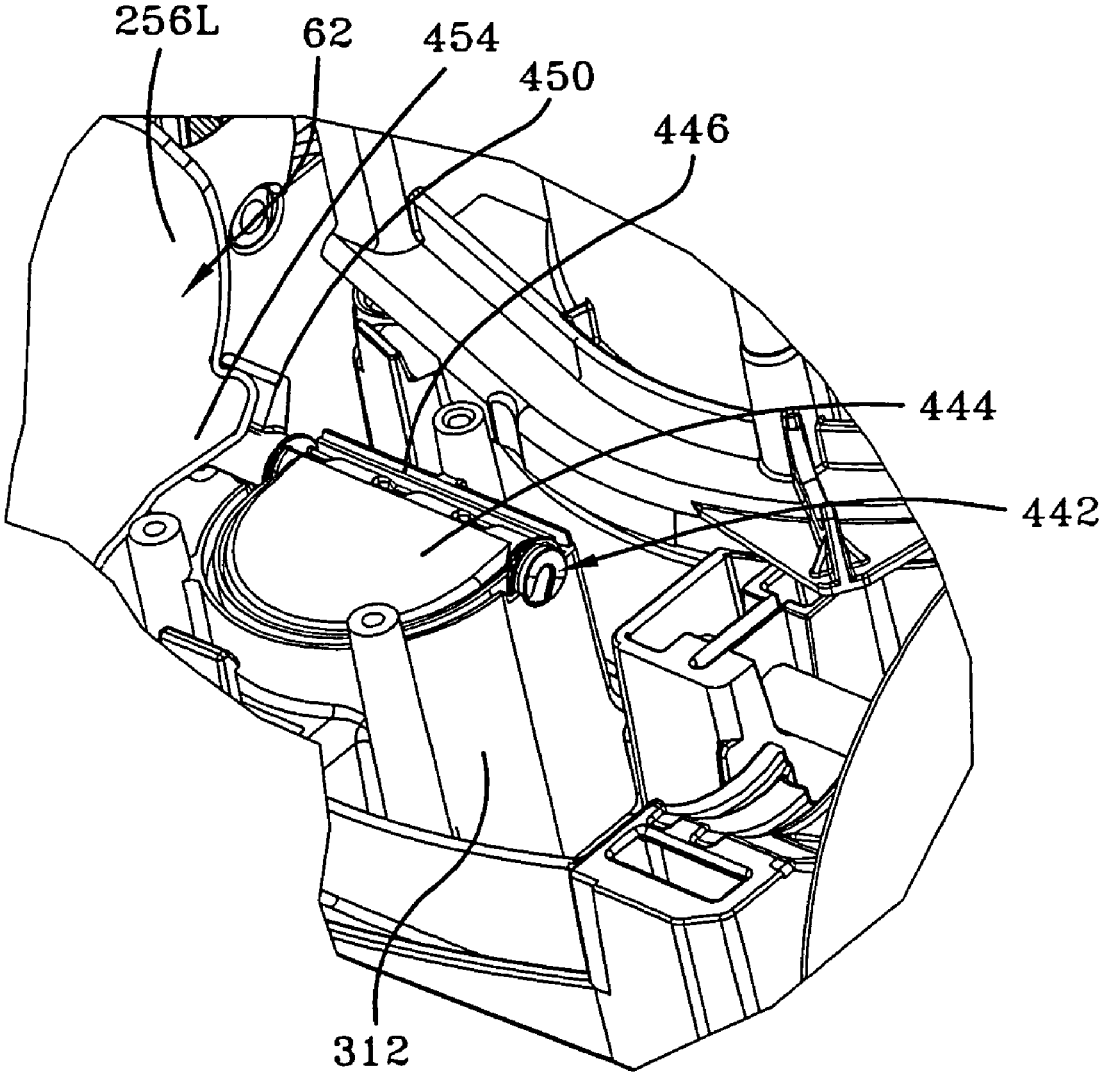
FIG. 19A is a fragmentary perspective view of the base assembly and handle assembly of the carpet extractor of FIG. 1 showing the stop valve arrangement and related elements with the stop valve in the closed position.
Figure 19B:
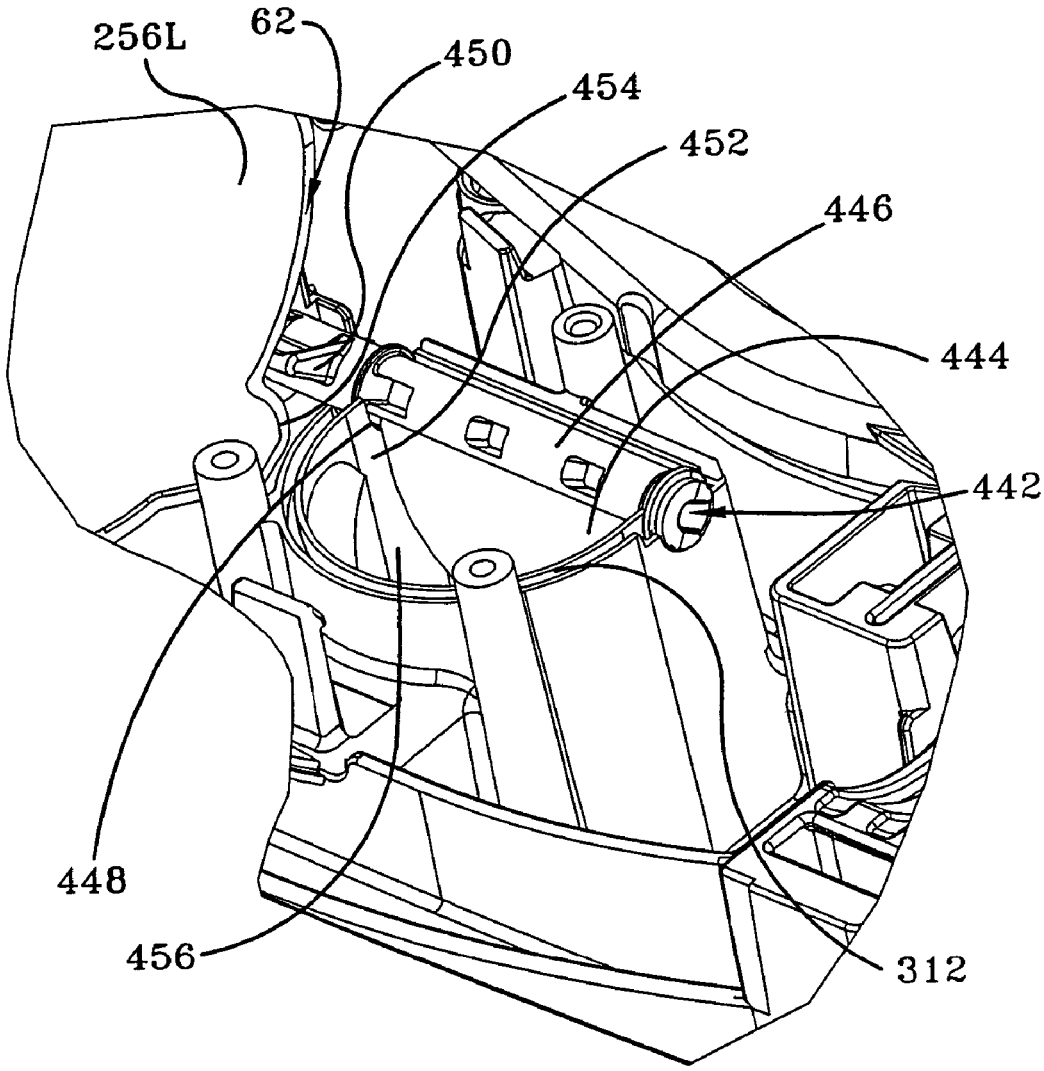
FIG. 19B is a view similar to FIG. 19A but showing the stop valve in the open position.
Figure 20:
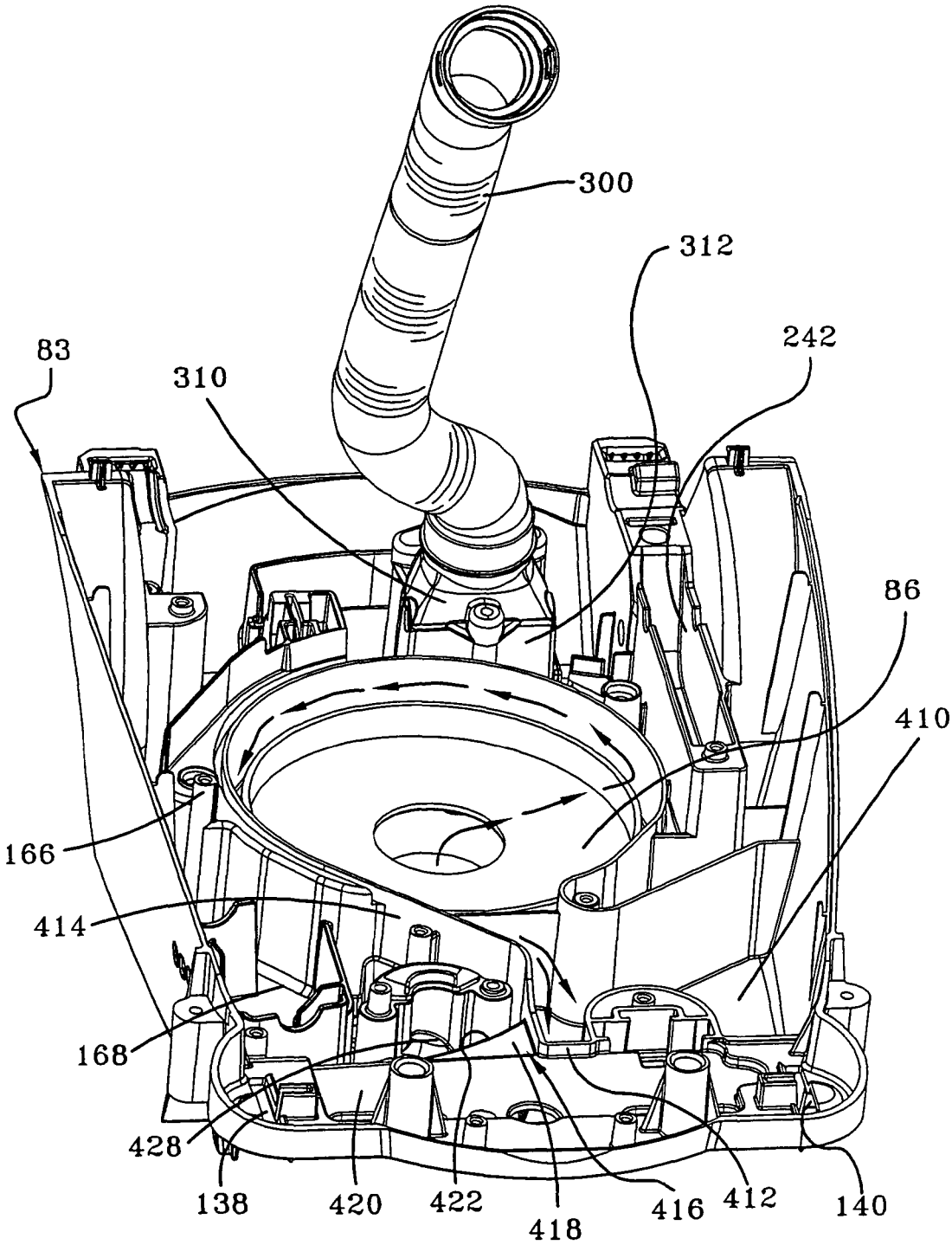
FIG. 20 is a perspective view of the frame of the base assembly with the air exhaust hose mounted to the standpipe for the carpet extractor of FIG. 1.

A hose mounting member 310 is attached to the downstream end of the air exhaust hose 300 and mounts the hose 300 to the frame 83 in fluid communication with a standpipe 312, which is integrally molded to the frame 83 as seen in FIG. 20. The standpipe 312 has a semi-circular cross section, as depicted in FIG. 19B, and is in fluid communication with the vacuum manifold 102 via conduit 303 (FIG. 4). The flexibility of the floor recovery hose 228 and air exhaust hose 300 allows the handle assembly 62 to pivot and also permits the hoses 228, 300 to bend and conform to the contour of the face plate 253 and lower body shell 254.

Figure 15:
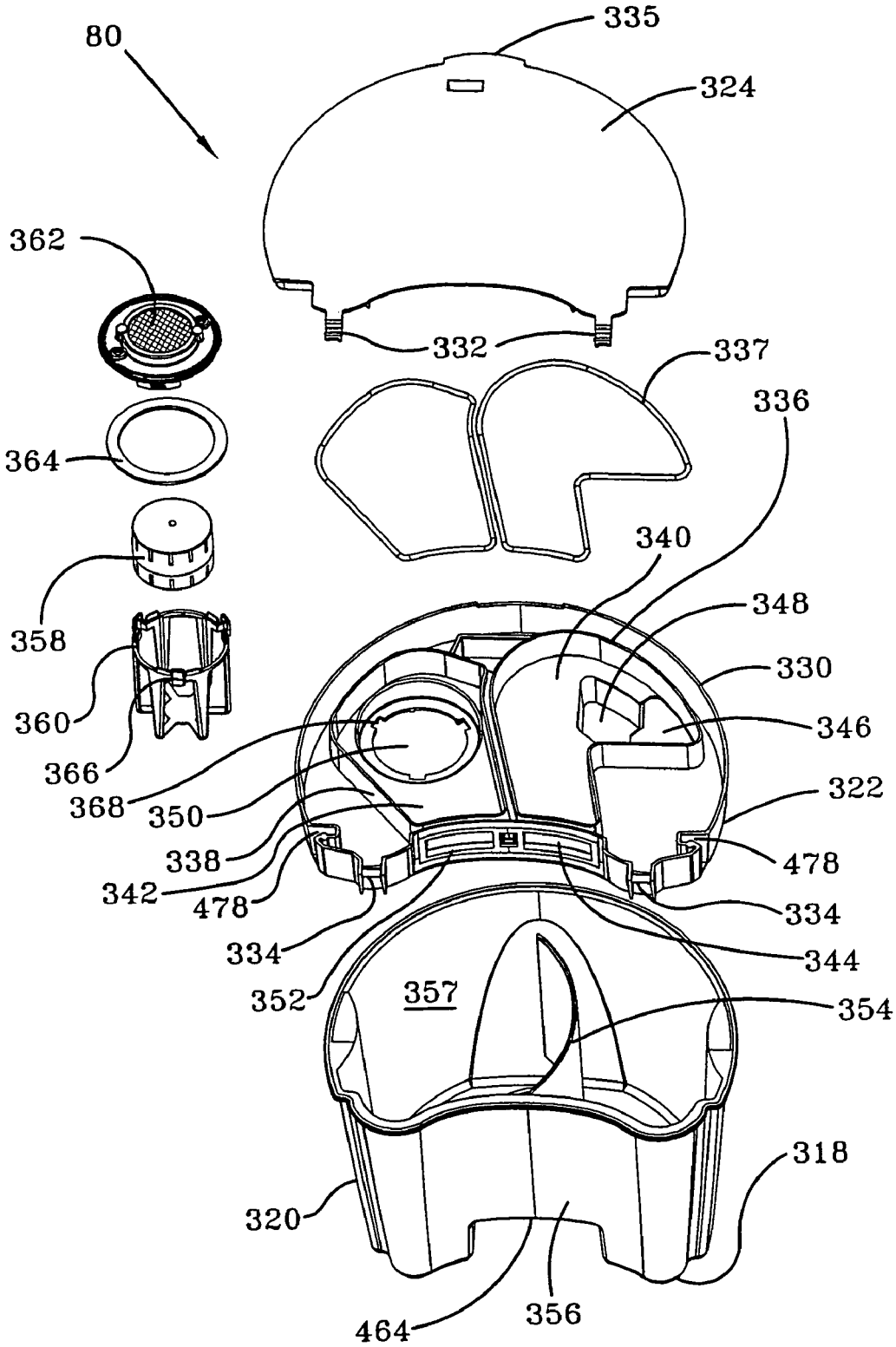
FIG. 15 is an exploded view of the recovery tank assembly and related elements for the carpet extractor of FIG. 1.

Referring to FIG. 15, the recovery tank 80 comprises bottom wall 318, an upstanding sidewall 320, and a top wall 322 welded upon the upper end of the sidewall 320. Opposite side recesses 492 (FIGS. 1 and 11) are formed in the sidewall 320 to allow a user to grasp opposite side portions of the top wall 322. A curved upstanding flange portion 330 is integrally formed with the top wall 322. The recovery tank 80 includes lid 324 removably secured upon the flange portion 330 to define a manifold 331 (FIG. 9) together with the flange 330 and top wall 322. Specifically, the lid 324 includes a pair of rear hooks 332 that slide under and pivotally receive respective lateral pins 334 extending across cut out portions of the flange 330. To remove the lid 324, a user grasps the front portion 335 of the lid 324 and pivots the lid 324 upwardly and rearwardly until the hooks 332 are positioned over the pins 334 to allow the lid 324 and hooks 332 to be simply lifted off the pins 334. Upstanding peripheral walls 336, 338 separate the manifold 331 into entrance and exit compartments 340, 342. An elastomeric seal 337 is secured between the lid and peripheral walls, The entrance compartment 340 has a horizontal inlet opening 344 and a vertical exit opening 346 formed in the top wall 322. The inlet opening 344 is in fluid communication with the entrance passageway 486 of the conversion valve assembly 484, when the recovery tank 80 is mounted to the handle assembly 62. A step 348 is formed adjacent the exit opening 346 to slow the fluid down thereby aiding separation of the air and liquid. The exit compartment 342 has an entrance opening 350 to the tank 80 and a side exit opening 352 in fluid communication with the exit passageway 488 of the conversion valve assembly 484. A curved upstanding baffle 354 is secured to the bottom wall 318 of the tank and is spaced very slightly from the rear portion 356 of the sidewall 320 but at about an inch from the front portion 357 of the sidewall 320 and to permit passage of the extracted liquid. The baffle 354 acts to limit the degree of fluid sloshing during the forward and reverse push-pull operation of the extractor 60 in the floor cleaning mode and assists in separation of liquid from the working air as described further below.

In addition to its function as an anti-slosh baffle, baffle 354 also serves to prevent the establishment of a "short circuited" working airflow from exit opening 346 of entrance compartment 340 directly to entrance opening 350 of exit compartment 342. The baffle 354 acts to disburse the incoming working air over that portion of the recovery tank's volume upstream of the baffle 354 by forcing the working air to pass through the small space between the baffle 354 and front portion 357 of the sidewall 320. Thus, the velocity of the air as it passes through tank 80 is slowed to a minimum value and the time that the working air spends within tank 80 is at a maximum thereby providing for more complete liquid precipitation.

In operation, when the extractor 60 is operated in the floor cleaning mode, working air, including entrained fluid and dirt, is drawn into the floor suction nozzle assembly 174, through the floor recovery duct 222, floor recovery hose 228, floor inlet 482, and entrance passageway 486 of the conversion valve assembly 484 and to the manifold 331 of the recovery tank 80. The recovered soiled liquid laden air enters the inlet opening 344 of the entrance compartment 340 and is directed by the wall 336 to the step 348 and exit opening 346 as seen by the arrows in FIG. 16. The liquid collects and flows through the space between the baffle 354 and front portion 357 of the sidewall 320 until it enters the entrance opening 350 to the exit compartment 342.

A float 358 is provided within a suitable float cage 360 secured to the top wall 322 and aligned under the entrance opening 350 to choke the flow of working air through the entrance opening 350 when the reclaimed fluid within recovery tank 80 reaches a desired level. A screen 362 with seal 364 is secured to the top of the float cage 360 to filter out large objects. The float cage 360, seal 364, and screen 362 are angled slightly rearwardly and downwardly so that they are positioned vertically and also closer to the higher portion of the liquid level, when the handle assembly 62 is inclined rearwardly. This orientation keeps the liquid from rising to a level that is in close proximity to the entrance opening 350 of the exit chamber 342 and possibly entering the motor area. This orientation also prevents the float 358 from prematurely choking the flow of working air through the entrance opening 350. To assemble the cage 360 to the top wall 322, tabs 366 integrally formed on the top of the cage 360 are inserted through complementary apertures 368 in the top wall 322 and then engage the top wall 322 upon the cage 360 being turned a sufficient distance, defining a "twist lock" arrangement. The air flows through an exit opening 352 of the exit compartment 342 and through the exit passageway 488 (FIG. 9) and outlet 490 of the conversion valve assembly 484 (FIG. 9).

After traveling through the air exhaust hose 300, the working air then travels through the standpipe 312 (FIG. 20) and conduit 303 of vacuum manifold 102 (FIG. 4) to the eye of the fan 408 (FIG. 2) of the suction motor 90, which generates the suction to draw the air to the fan 408. As indicated by the arrows depicted in FIG. 20, the working air flows out of the eye of the motor fan 408 into exhaust manifold 410. The exhaust manifold 410 is formed by the lower housing or frame 83 and motor cover 230 (FIG. 5), and a curved partition 414 which extends forwardly to an integrally formed wall 412 adjacent the brush assembly 70. The working airflow is directed by the partition 414 to the front end of the exhaust manifold 410 at the entrance of a channel 416.

The channel 416 is formed by a top wall 418, a front wall 420, and a rear wall 422 of the lower housing 83. A duct cover 424 (FIG. 4), integrally molded with the bottom plate, is mounted over the channel 416. A wall 428, integral with and depending down from the frame 83 to the bottom plate 101, separates or fluidly isolates the channel 416 from the conduit 303. Going from the upstream end to the downstream end of the channel 416, the top wall 418 tapers inwardly or downwardly within the channel 416 and the rear wall 422 tapers inwardly or forwardly within the channel 416 thereby causing the cross sectional area of the channel 416 to gradually decrease going downstream. The air flows at a relatively high velocity to the front end until it hits the wall 412, which directs the air down through the channel 416 and across the length of the duct cover 424, where the air exits out of openings 426 in the duct cover 424. The decreasing cross sectional area of the channel 416 forces the air to flow faster as it travels downstream so as to counteract somewhat the frictional forces and gravity that cause the air to slow down. The channel 416 and openings 426 of the cover 424 also constrict the flow of air thereby increasing its temperature by transforming kinetic energy produced by the working fan into internal energy or heat, which is transferred to the warm, moist, separated exhaust air. Thus, additional heat is provided to the cleaning path. Referring to FIGS. 19A and 19B, a stop valve 442 disposed in the standpipe 312 prevents liquid from entering the suction motor if the handle assembly 62 is pivoted down below a predetermined position. Such a rear horizontal handle assembly 62 position results in the liquid collecting in the rear of the recovery tank 80 and rising to close proximity to the entrance opening 350. The stop valve 442 includes a door 444 integrally molded with a pivoting shaft 446. The shaft 446 is pivotally received in arcuate surfaces 448 (FIG. 19B) formed on opposite sides of the standpipe 312 near the front portion and captured therein by the hose mount 310 (FIG. 20). A cam follower 450, integrally molded to the shaft 446, projects from the shaft 446. The door 444 is generally semi-circular in shape, conforming to the semi-circular cross section of the standpipe 312, and of a cross sectional area slightly smaller than that of the standpipe 312 so as to allow it to pivot within the standpipe 312. When the handle assembly 62 is in the upright position or pivoted down to the inclined working position, as shown in FIG. 19B, the force of the suction from the suction motor 90 pivots the door 444 down against straight front side 452 of the standpipe 312, thereby opening the stop valve 442 and allowing suction generated by the suction motor to draw air through the standpipe 312.

However, when the handle assembly 62 is pivoted further down to a very low predetermined position, a downwardly extending offset portion 454 on the lower end of the left handle extension 256L cams against the cam follower 450 and pivots the door 444 up to the inlet 456 of the standpipe 312 in a closed position as shown in FIG. 19A. In this position, the door 444 extends across the interior of the standpipe 312 and blocks or substantially blocks the suction from the suction motor, thereby shutting or substantially shutting off suction through the flowpath to the floor suction nozzle assembly 174 and the accessory hose. Thus, fluid is prevented from being drawn through the flowpath to the suction motor 90. When the handle assembly 62 pivots back to the working position, the offset portion 454 disengages from the cam follower 450 so that the force of the suction from the suction motor 90 pivots the door 444 back down against the front side 452 of the standpipe 312 to the valve open position.

Referring to FIG. 9, a support shelf 460 for supporting the solution tank 76 is mounted by screws to the front body shell faceplate 253 and extends forwardly. A cleaning solution reservoir 494 is received in a recess 500 formed in the support shelf 460 and faceplate 253. The reservoir 494 receives and holds a quantity of cleaning solution from the solution tank 76 for distribution to supply tubes 496, 498 (FIG. 17) as further described below. Upon assembly of the faceplate 253 to the lower body shell 254, the forward half of the reservoir 494 protrudes through the recess 500 aligning with the top surface of the support shelf 460 such that the support shelf 460 is generally planer with the top surface of shelf 460. The solution tank 76 is removably mounted upon the support shelf 460 of the handle assembly 62.

Figure 14:
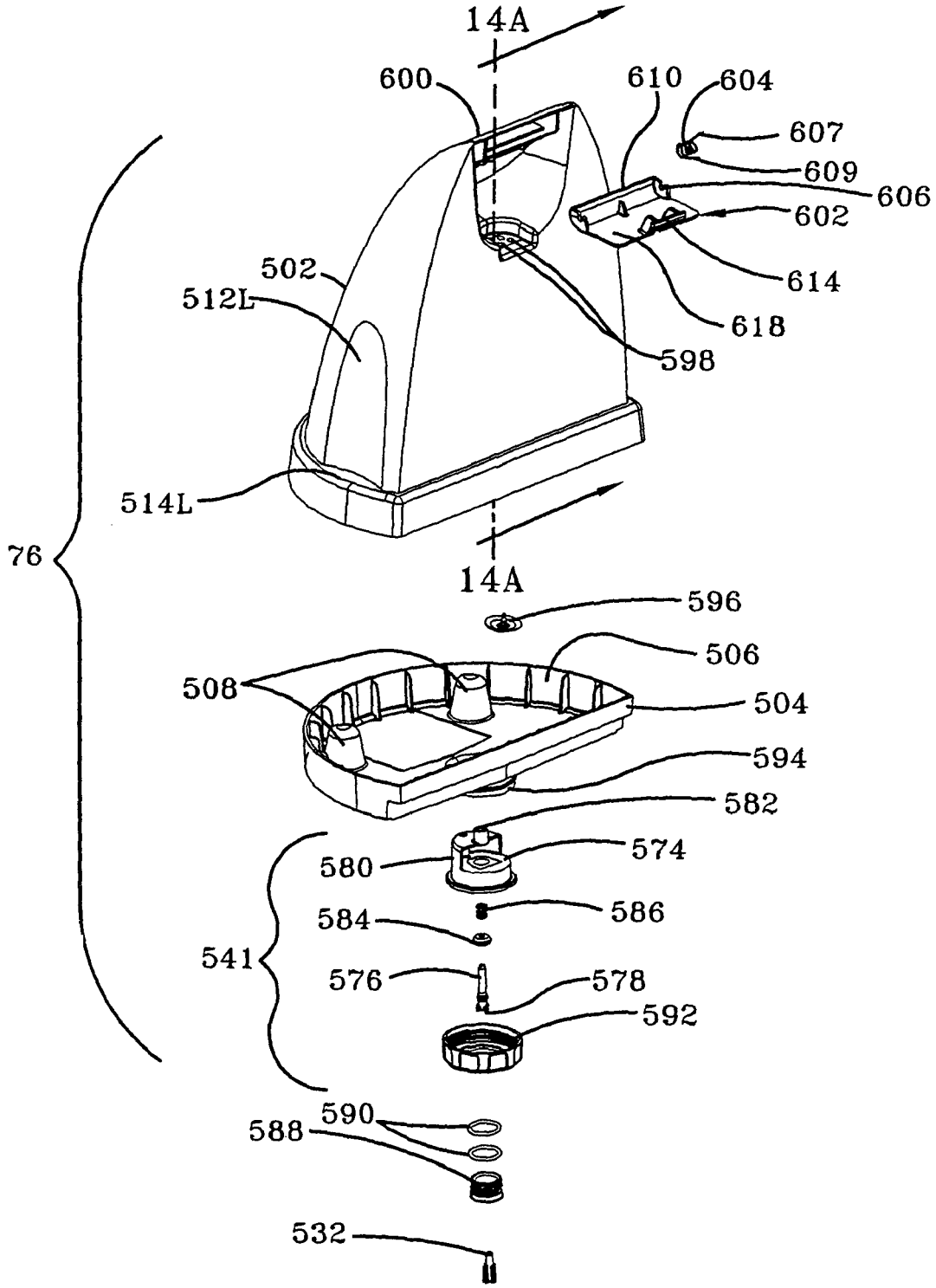
FIG. 14 is a rear exploded view of the solution tank and cleaning solution reservoir assembly.
Figure 14A:
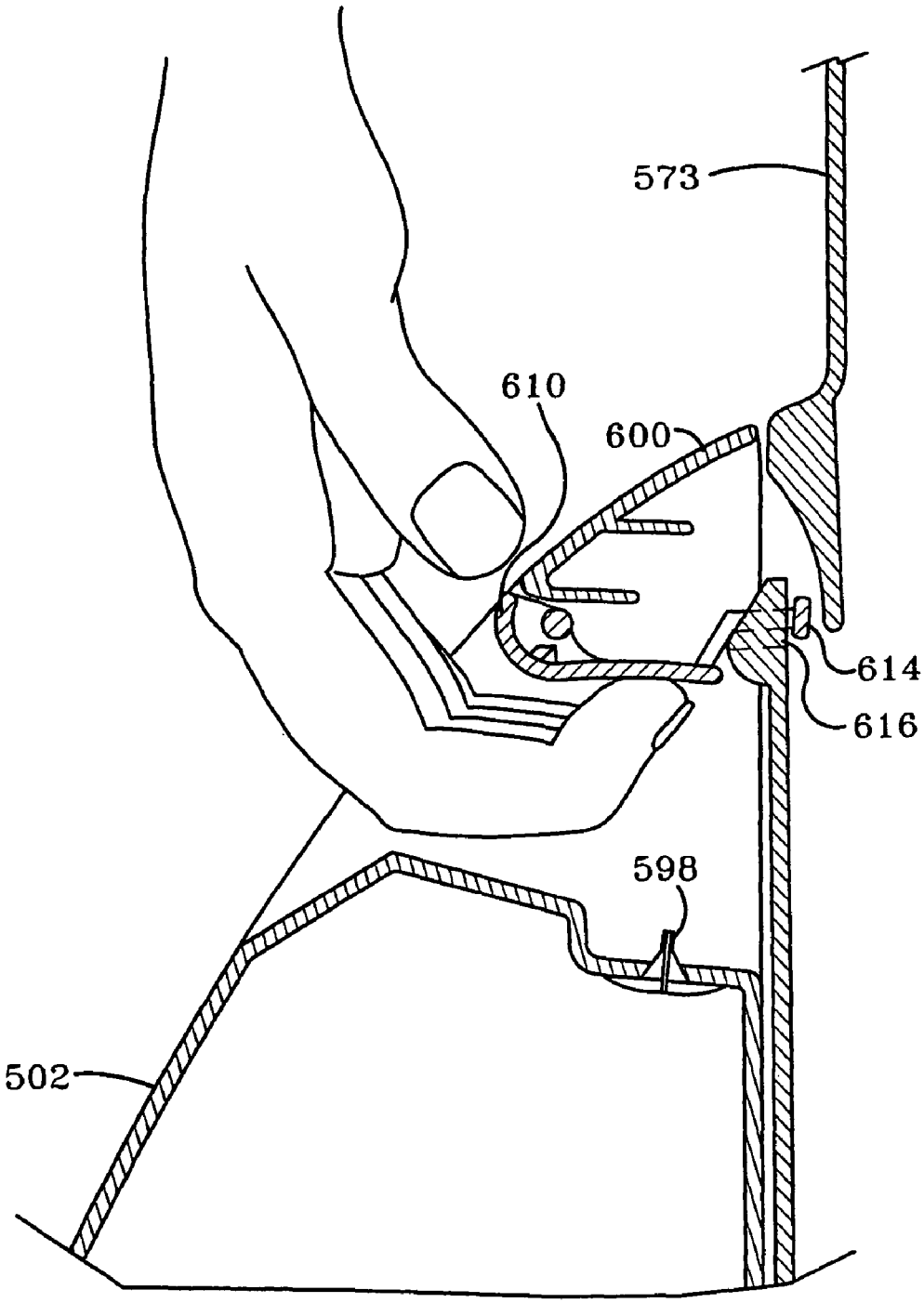
FIG. 14A is a view taken along the line 14A-14A of FIG. 14 showing the tank handle in the latched position.
Figure 14B:
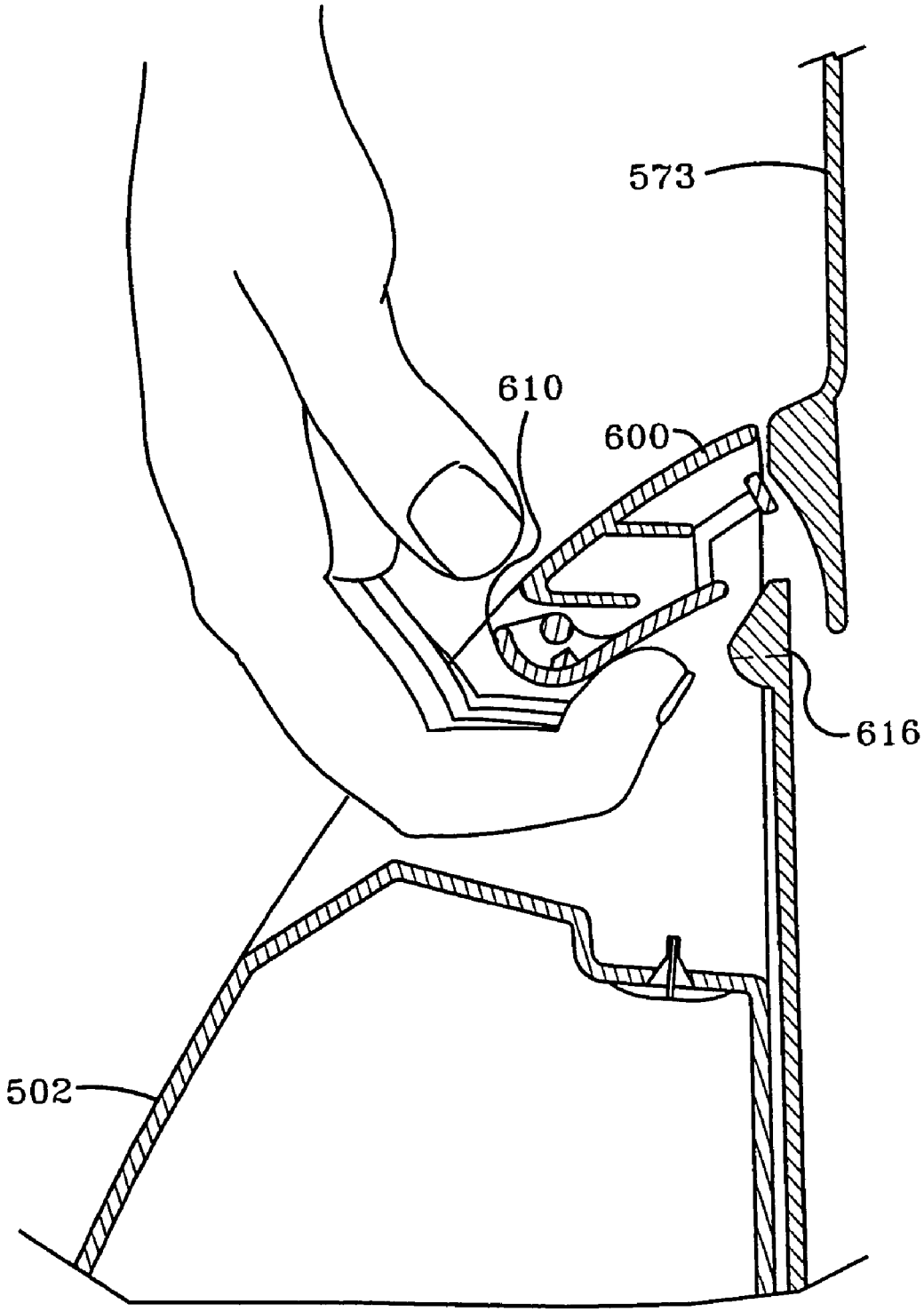
FIG. 14B is a view similar to FIG. 14A, but showing the tank handle in the unlatched position.

As depicted in FIG. 14, the solution tank 76 comprises a deeply hollowed upper body 502 and a relatively planer bottom plate 504 which is welded about its periphery to the upper body 502. A skirt 506 extends around the forward end of the bottom plate 504. The bottom plate 504 is provided with suitable recess areas 508, which index upon and receive therein corresponding raised projections 510 (FIG. 9) on the support shelf 460, when the solution tank 76 is placed upon the shelf 460. Side portions 512L, 512R (FIG. 11) of the tank body 502 are scalloped to expose opposite ledge portions 514L, 514R (FIG. 11) to provide a holding area for the hands of a user when filling the solution tank through opening 594. As seen in FIG. 9, a u-shaped cavity 516 formed in the faceplate 253 just above the support shelf 460 receives a detergent measuring cup 518 removably stored therein.

Figure 17:
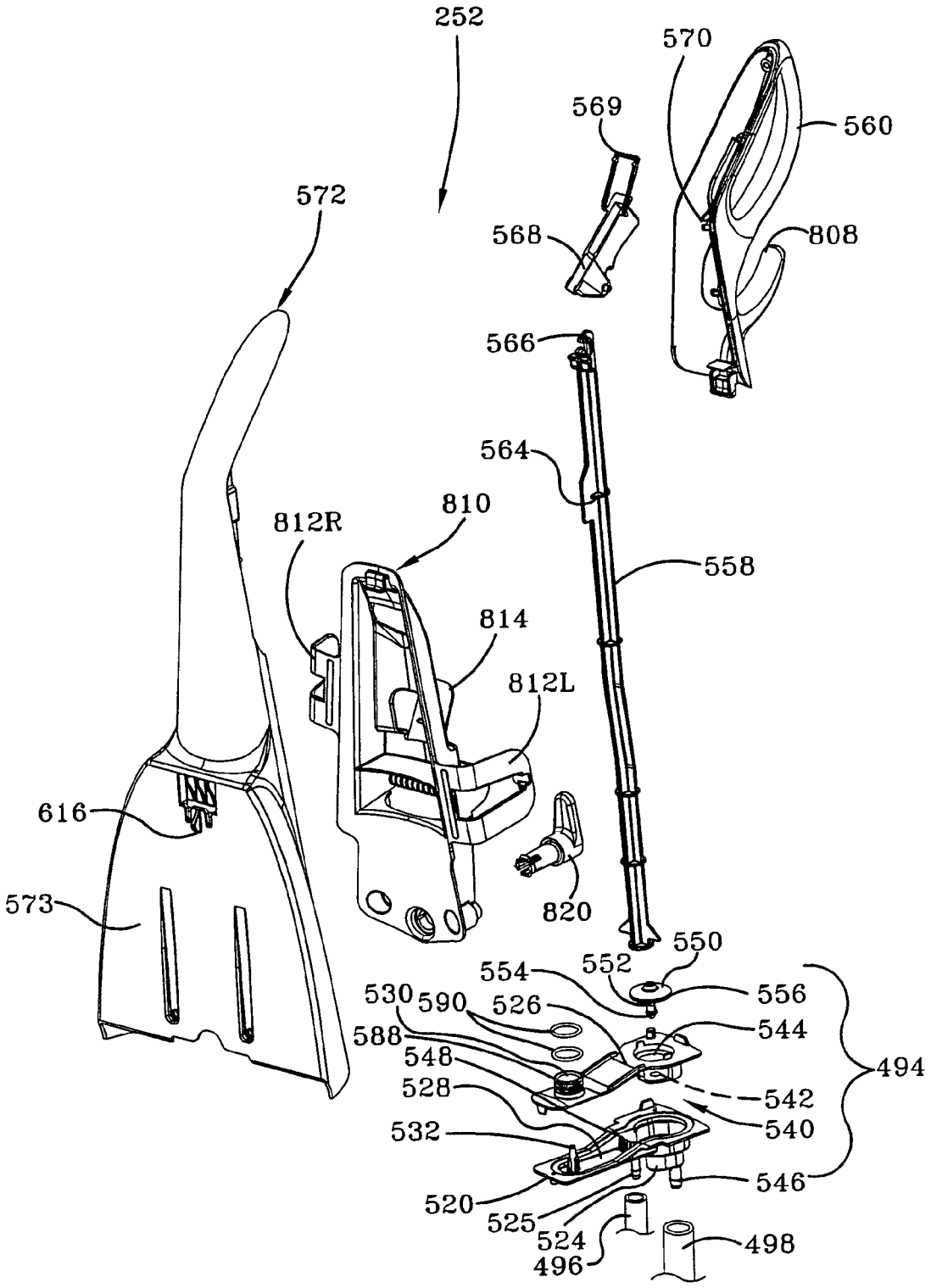
FIG. 17 is an exploded view of the upper handle assembly.

Referring to FIG. 17, the cleaning solution reservoir 494 includes a bottom basin 520 having the two supply tubes 496, 498 exiting therefrom. The supply tube 496 provides a direct supply of cleaning solution through discharge port 525 from reservoir to the accessory tool 700, while supply tube 498 provides a valved release of cleaning solution from reservoir 494 to the cleaning solution distributor 107 (FIG. 5)

Cover plate 526 is welded to basin 520 and thereby forms a reservoir volume 528 which solution tank 76 floods with cleaning solution through inlet port 530. Extending axially upward through inlet port 530 is pin 532, which acts to open supply valve 541 (FIG. 14) of the solution tank 76 as the tank 76 is placed upon the support shelf 460 (FIG. 9) and secured in place. An upstanding cylindrical boss 588, integrally formed on the top cover 526, surrounds the pin. Two O-rings 590 are fitted around the boss 588 to seal the reservoir to the solution tank 76, when the solution tank 76 is mounted to the handle assembly 62.

Cleaning solution is released upon operator demand into tube 498 through solution release valve 540 which comprises a valve seat 542 positioned in basin 524 of bowl 544 integrally formed with top cover 526. The basin 524 of bowl 544 extends across discharge port 546 such that valve seat 542 is aligned to open thereinto. An opening 548, within the wall of bowl 544, permits the free flow of cleaning solution from reservoir 528 into bowl 544. An elastomeric valve member 550 comprises an elongate piston 552 extending through valve seat 542 having a bulbous nose 554 at the distal end thereof within discharge port 546. The opposite end of piston 552 includes a downwardly sloped circular flange 556, the peripheral end of which frictionally and sealingly engages the upper circular rim of bowl 544 thereby preventing leakage of cleaning solution thereby. Flange 556 acts to bias piston 552 upward thereby urging nose 554 into sealing engagement with valve seat 542 preventing the flow of cleaning solution from bowl 544 into discharge port 546 and tube 498.

The solution release valve 540 is operated by pressing downward upon the elastomeric release valve member 550 by push rod 558, thereby deflecting the center of flange 556 downward urging nose 554 downward and away from valve seat 542 permitting the passage of cleaning solution therethrough into discharge port 546 and tube 498. Energy stored within flange 556, as a result of being deflected downward will, upon release of the force applied to push rod 558, return the valve to its normally closed position as illustrated in FIG. 9

The push rod 558 articulates and extends upwardly through handle assembly 62. The push rod 558 is positioned within the handle assembly 62 by means of integrally molded spacer 564 dimensioned and located as necessary. The upper end 566 of the push rod 558 is pivotally attached to trigger 568. Integrally molded onto the lateral sides of the trigger 568 is a cantilever spring 569. Trigger 568 is pivotally attached to the handle at pivot 570; thus cantilever spring 569 urges trigger 568 and the attached articulated push rod 558 towards the valve closed mode. A looped hand grip 560 captures the push rod 558 and trigger 568 to the upper handle body 572.

Cantilever spring 569 is engineered to support the weight of the push rod 558 such that no force is applied to elastomeric valve member 550. Upon the operator squeezing the hand grip 560 and trigger 568, cantilever spring 569 yields thereby permitting counterclockwise rotation of trigger 568 about pivot 570 with a resulting downward movement of push rod 558 thereby opening solution release valve 540 causing gravitational flow of cleaning solution from reservoir 528 to tube 498. Upon release of trigger 568, energy stored in the system returns valve 540 to the closed mode.

As depicted in FIG. 14, removably mounted into bottom plate 504 of the solution tank 76 is a solution release valve 541 comprising valve seat 574 having an elongate plunger 576 extending coaxially upward therethrough. Plunger 576 having an outside diameter less than the inside diameter of valve seat 574 is provided with at least three flutes 578 to maintain alignment of plunger 576 within valve seat 574 as plunger 576 axially translates therein and permits the passage of fluid therethrough when plunger 576 is in the open position.

An open frame housing 580 is located atop valve seat 574 having a vertically extending bore 582 slidingly receiving therein the upper shank portion of plunger 576. An elastomeric circumferential seal 584 circumscribes plunger 576 for sealingly engaging valve seat 574. Seal 584 is urged against valve seat 574 by action of compression spring 586, circumscribing plunger 576, and positioned between frame 580 and seal 584. Solution release valve 541 is normally in the closed position. However, as solution tank 76 is placed upon support shelf 460 of handle assembly 62, pin 532 of the cleaning solution supply reservoir 528 aligns with plunger 576 and is received within flutes 578, thereby forcing plunger 576, upward compressing spring 586, and opening valve seat 574 permitting cleaning solution to flow from solution tank 76 into reservoir 528. Upon removal of solution tank 76 from support shelf 460, the energy stored within compression spring 586 closes valve seat 574. A threaded cap 592 is threadily secured on a boss 594, integrally molded on the bottom plate 504, to removably mount the solution release valve 541 to the bottom plate 504 of the solution tank 76.

A check valve 596 in the form of an elastomeric umbrella valve is provided in the top of the solution tank 76 to assure that the ambient pressure within tank 76 remains equal to atmospheric, as cleaning solution is drawn from tank 76. A multiplicity of air breathing orifices 598 are formed in the top of the tank and extend to the umbrella valve 596. As the ambient pressure within tank 76 drops, by discharge of cleaning solution from therein, atmospheric pressure acting upon the top side of umbrella valve 596 causes the peripheral edge of the umbrella valve 596 to unseat from the underside surface of the top of the tank 76, thereby permitting the flow of atmospheric air into tank 76 until the ambient pressure therein equals atmospheric. Once the pressure on both sides of the umbrella valve 596 equalize, the energy stored by deflection of the umbrella valve causes the peripheral edge to reseat itself against the underside surface thereby preventing leakage of cleaning solution through orifices 598 during operation of the extractor 60.

Referring to FIGS. 9 and 14, integrally formed at the top of the solution tank 76 is a carry handle 600. A solution tank latch 602 releasably secures the solution tank 76 to the upper handle body 572. The plate like latch 602 is pivotally connected to the underside of the carrying handle 600 and biased downwardly by a torsion spring 604 provided between the latch and carry handle. Specifically as shown in FIG. 1, the torsion spring 604 receives a pin 605, integrally formed on the center of the carry handle 600, and includes an upper end leg 607 (FIG. 14) abutting against the under side of the carry handle 600 and a lower end leg 609 (FIG. 14) abutting against the top surface of the latch 602. The latch 602 includes a pair of arcuate surfaces 606 that pivotally receive complementary pins 608 (FIG. 9) on the handle 600. A front flange 610 extends upwardly and partially over the front portion 612 of the carrying handle 600, and acts as a stop or limit to prevent the latch 602 from pivoting below a horizontal plane. The latch 602 includes a ring member extending from its rear end that defines a catch 614. The catch 614 receives an upstanding tongue member 616 (FIG. 17) integrally formed on front side 573 of upper handle body 572 to secure the solution tank 76 to the upper handle body 572.

To remove the solution tank 76 from the upper handle body 572 and face plate 253, a user grasps the carrying handle 600 and latch 602 and pushes upwardly on the rear portion 618 of the latch 602 a sufficient distance to clear or disengage the catch 614 from the tongue member 616 and then pulls the solution tank 76 away from the upper handle body 572 and face plate 253. It should be appreciated that one skilled in the art could utilize same type of handle and latch on a recovery tank if the recovery tank 80 were positioned on the shelf 460. The rear of the solution tank 76 abuts against the generally flat or planar front side 573 of the upper handle body 572 and flat or planar upper front portion 255 of the front body shell face plate 253. In essence, the projections 510 and recesses 508 connection, and the latch 602 and tongue member 616 connection adequately secure and support the solution tank laterally. Thus, there is additional room to accommodate a solution tank 76 that is larger in size than that needed to fit into the area if it was recessed to form a forward cavity for laterally supporting the solution tank. As seen in FIGS. 1 and 11, the parting line 671 between the solution tank 76 and handle assembly 62 is aligned with the parting line 673 between the recovery tank 80 and handle assembly 62, and the two parting lines together form a substantially straight line. This produces a stacked arrangement of the solution tank 76 above the recovery tank 80 in which the tanks are in alignment with each other. Optionally, the solution tank 76 or recovery tank 80 can also wrap partially around the handle assembly 62 in a saddle type arrangement.

Figure 24:
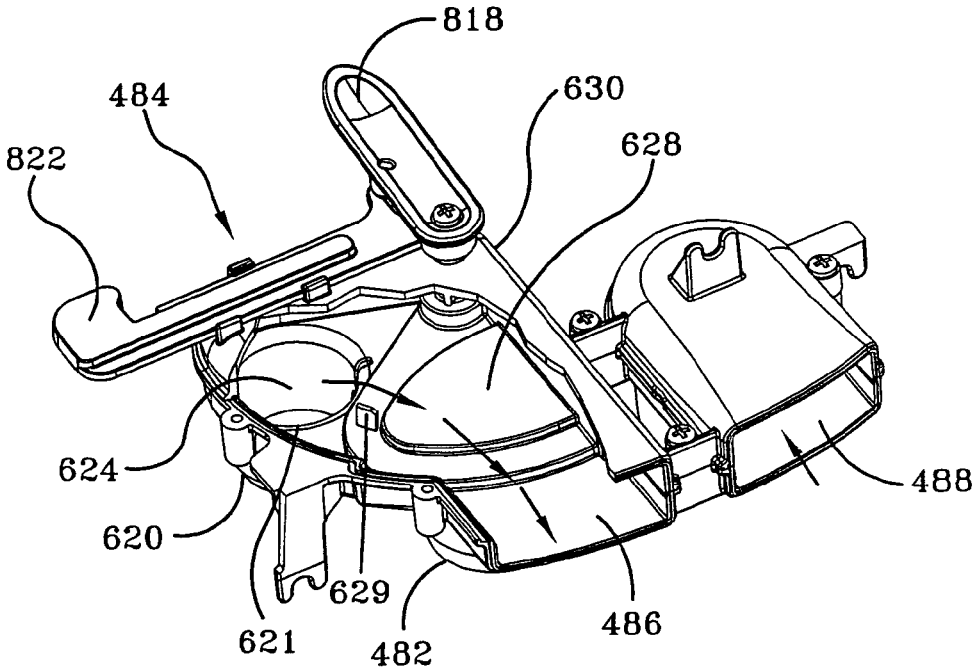
FIG. 24 is a perspective view of the conversion valve assembly positioned in the upholstery or above the floor cleaning mode of the carpet extractor of FIG. 1 with portions broken away for illustrative purposes.
Figure 24A:
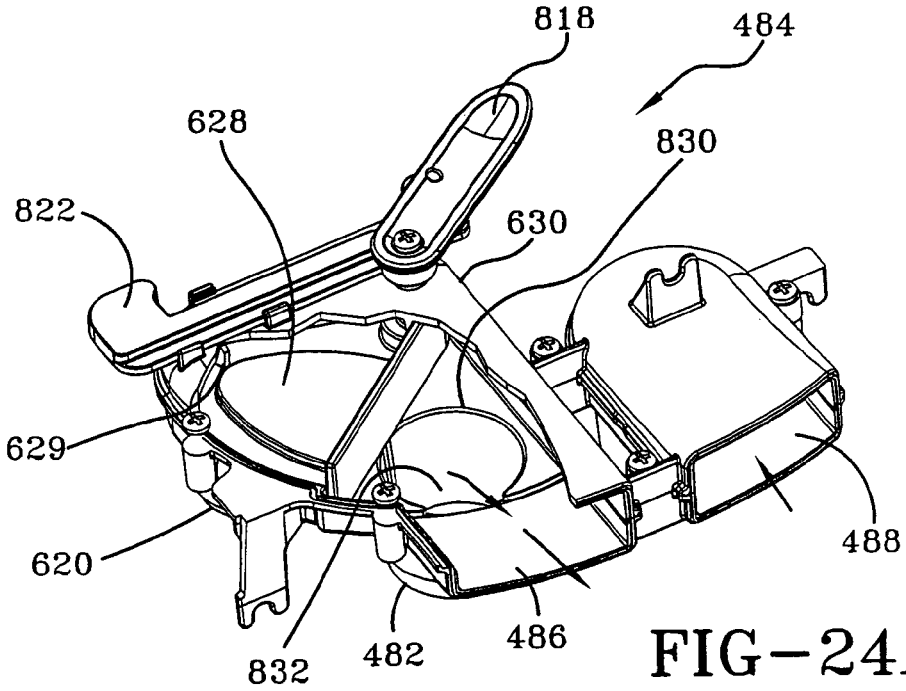
FIG. 24A is a view similar to FIG. 24 but with the conversion valve assembly being positioned in the floor operating mode.
Figure 25:
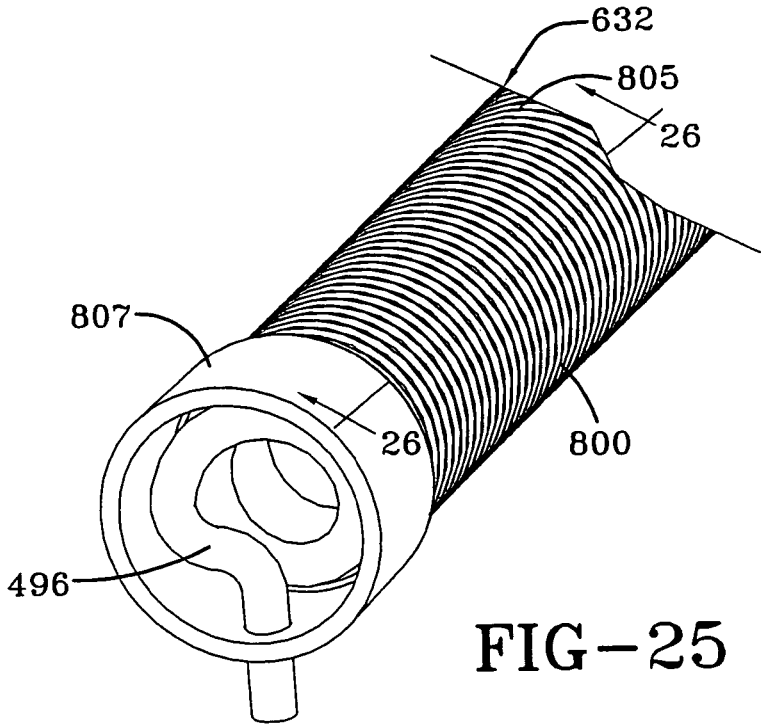
FIG. 25 is a perspective view of a portion of the accessory hose assembly.

The arrangement for above the floor or upholstery cleaning will now be described. Referring to FIGS. 24 and 24A, the conversion valve assembly 484 includes an accessory inlet 620 that leads to accessory passageway 624. A rotary valve 628 member is pivotally connected to the valve body 630 of the conversion valve assembly 484 and selectively pivots between two positions for either floor cleaning or above the floor cleaning. An upstanding boss 629 is attached to the valve 628 and abuts the underside of the valve body 630 to support the valve 628 horizontally and prevent it from flexing. An accessory hose assembly 632 (FIG. 11) is fluidly connected at its proximal end to the accessory inlet 620. An accessory tool 700 (FIG. 11) is selectively fluidly connected to the distal or free end 638 of the accessory hose assembly 632.

Figure 18:
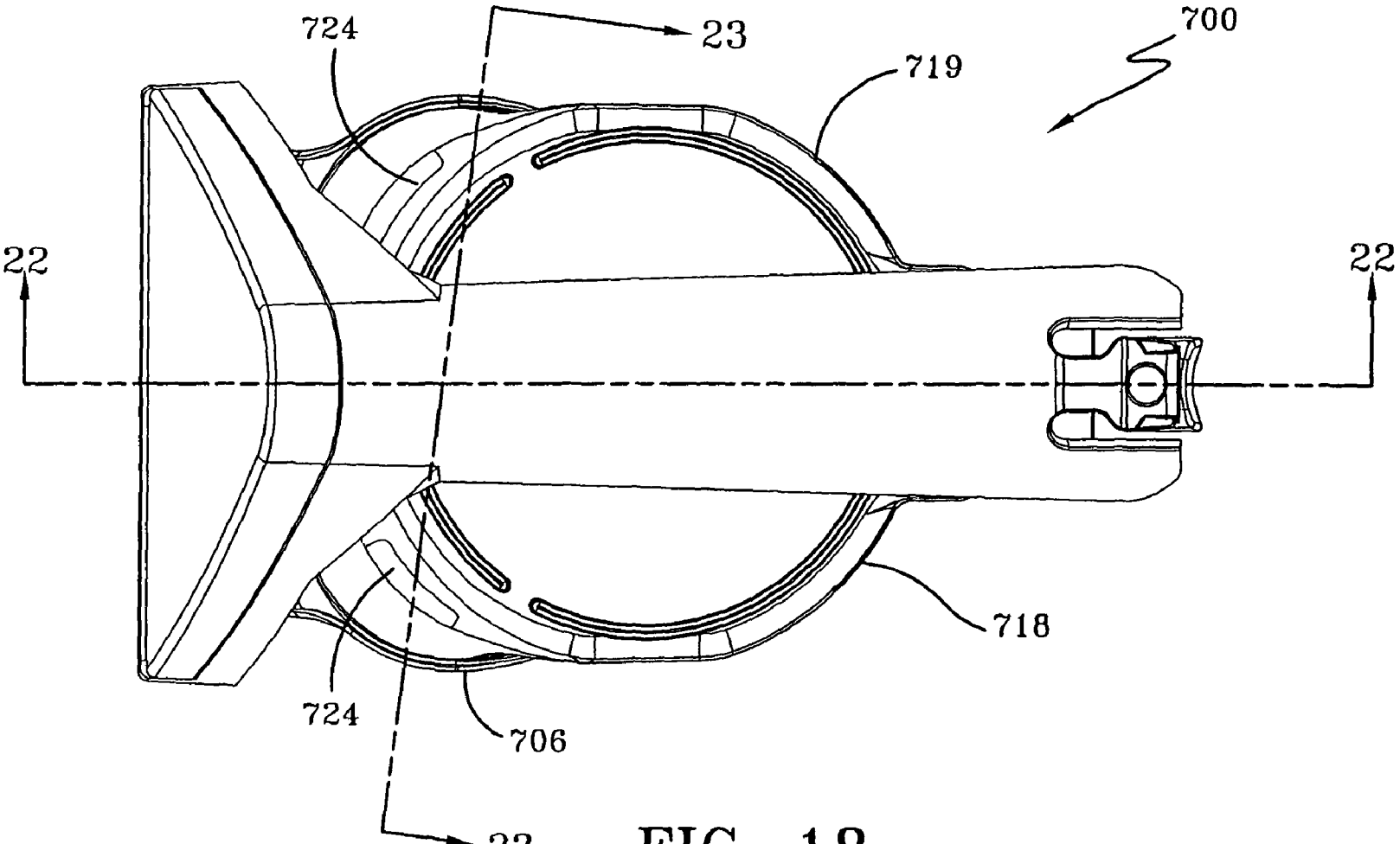
FIG. 18 is a top view of the accessory tool for the carpet extractor of FIG. 1.
Figure 22:
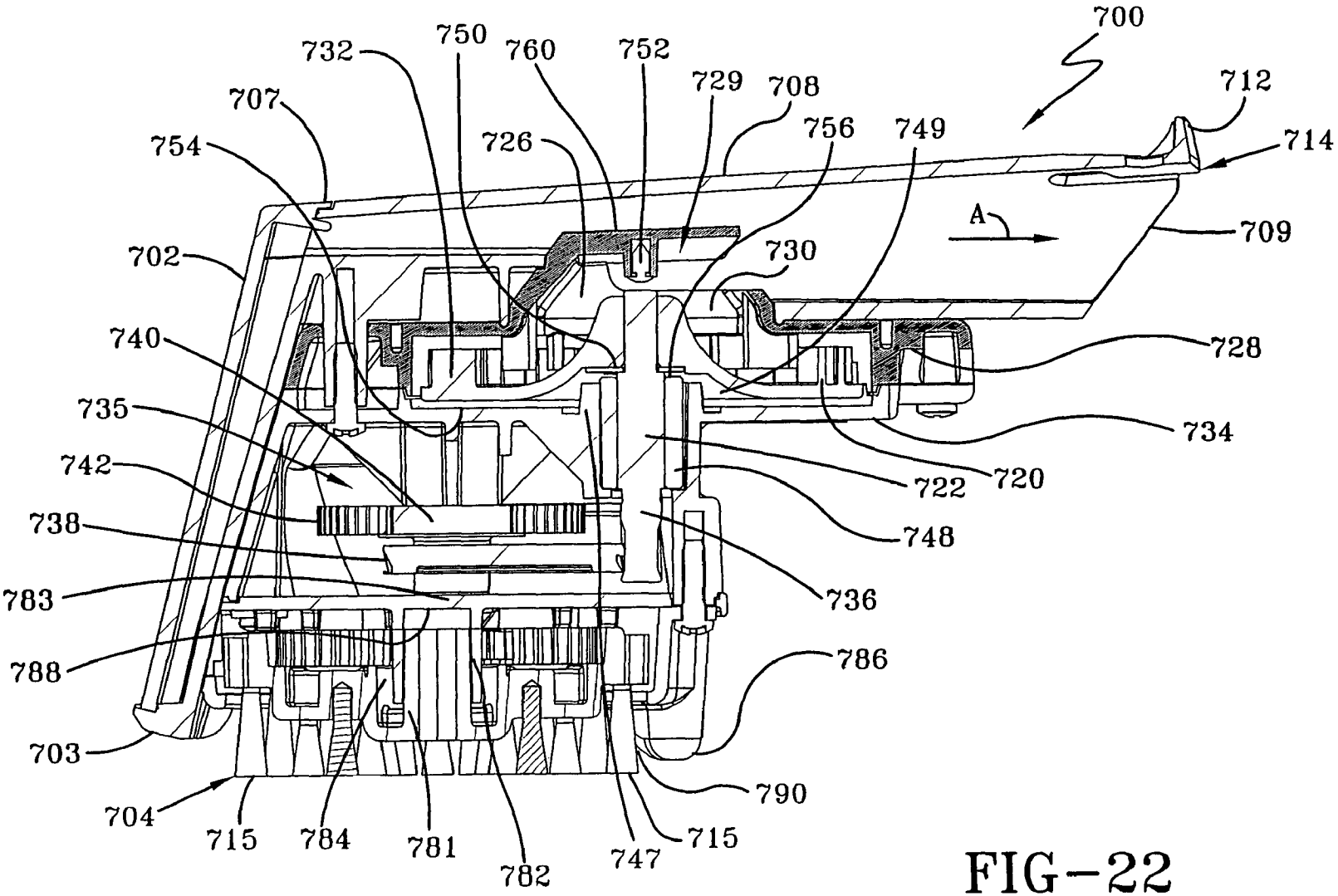
FIG. 22 is a sectional view taken along line 22-22 of FIG. 18.
Figure 23:
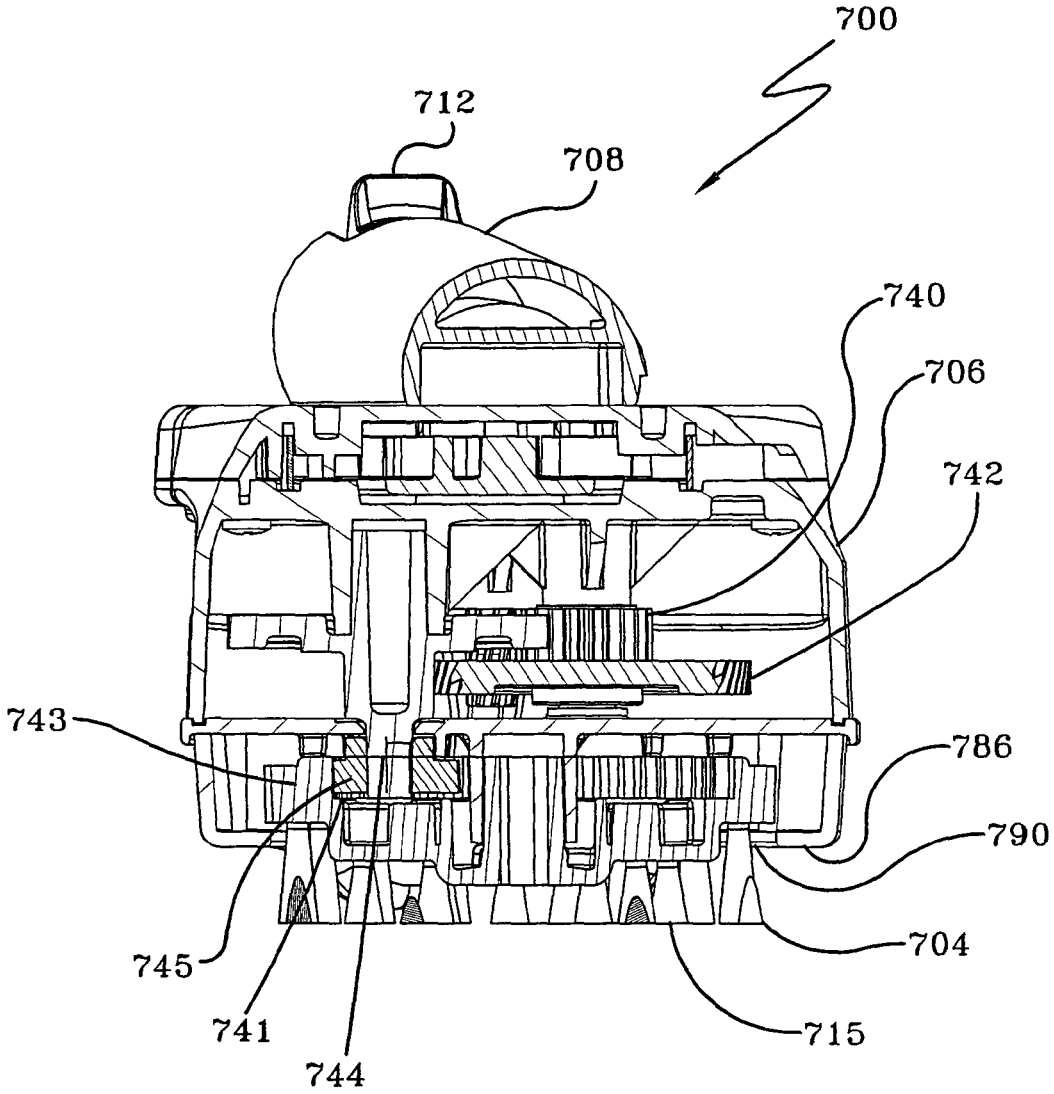
FIG. 23 is a sectional view taken along line 23-23 of FIG. 18.

Referring now to FIGS. 18, 22, and 23, the accessory tool 700 includes an extractor nozzle 702 and one vertical axis rotary scrub brush 704 that is driven by an air powered turbine 706. The extractor nozzle 702 has a narrow, elongated nozzle inlet 703 for extracting liquid from a surface to be dried or cleaned and is fixed to a first end 707 of a suction tube 708. The second end 709 of the suction tube 708 is mounted to distal hose end 638 of the accessory hose assembly 632. The power nozzle accessory tool 700 is released from the hose end 638 by depressing a retaining nub 712 extending from a resilient tab 714 integrally formed with the second end 709 of the suction tube 708. A typical on-off trigger operated valve 634 (FIG. 11) is provided on the hose end 638 to control the amount of solution dispensed. Further details of the valve are disclosed in U.S. Pat. No. 5,870,798; the disclosure of which is incorporated by reference.

The turbine 706 and the brush 704 are mounted to the suction tube 708 adjacent to the nozzle 702 by screws or other suitable fastening means. The turbine 706 includes a relatively flat generally disc or pancake shaped turbine housing 718 defining a generally disc or pancake shaped turbine chamber therein. A generally disc shaped turbine rotor 720 is rotatably mounted in the turbine housing 718 on an axle 722. The turbine housing 718 is defined by an upper end wall 728 and a lower end wall 734 connected by a peripheral wall 719 enclosing the turbine chamber.

A plurality of turbine inlet openings 724 pass through the peripheral wall 719 of the turbine housing 718 and a turbine outlet opening 726 passes through a center of the upper wall 728 of turbine housing. The turbine outlet opening 726 communicates an eye 729 of the turbine 706 with a turbine exhaust opening 730 passing through a lower side of the suction tube 708, such that when suction is applied to the suction tube 708, as indicated by arrow A, ambient air is drawn in through the turbine inlet openings 724 through turbine blades 732 on the turbine rotor 720 and out through the turbine outlet opening 726, thereby driving the turbine rotor 720. Screens are preferably mounted in the turbine inlet openings to prevent dust, lint and other debris from being drawn in the inlet openings and fouling the turbine.

The terms upper and lower are used in relation to the accessory power nozzle tool 700 as illustrated in FIGS. 18, 22 and 23 with upper meaning toward the suction tube 708 and lower meaning toward the brushes 704. Likewise, the term forward means toward the nozzle 702 and rearward means toward the hose end 638. It can be appreciated that the orientation of the accessory tool 700 changes during use. As such, the terms upper, lower, forward and rearward, as used in the description and the appended claims, are only intended to describe the parts of the nozzle when the nozzle is in the orientation illustrated in FIGS. 18, 22 and 23 with the brushes 704 and nozzle inlet 703 facing down.

Referring now to FIGS. 22 and 23, a portion or first end of the turbine axle 722 extends through the lower wall 734 of the turbine housing 718 (FIG. 18) and drives the brushes 704 via a gear train 735. The gear train is preferably a conventional gear reduction. The portion of the axle outside the turbine housing has helical gear teeth formed integrally therewith forming a gear shaft 736. The helical teeth on the gear shaft 736 engage helical gear teeth on an outer periphery of a reducing or idler gear 738, such that the reducing gear 738 is driven by the turbine rotor 720. A reduced diameter portion 740 of the idler gear 738 engages and drives a spur gear 742. A drive shaft 744 is integrally formed with the spur gear. The drive shaft 744 has a non-circular cross section that is non-rotatably received in a correspondingly sized and shaped central opening in an idler gear 745. The idler gear 745 has teeth that mesh with teeth on recess 741 formed on top 743 of the spur gear 742 for the brush 704 for rotationally driving the brush 704.

In order to rotatably mount the turbine rotor 720 in the turbine housing 718 with minimal friction, the axle 722 is mounted in the lower end wall 734 in a sleeve bearing 748 and a thrust washer 750 is mounted over the axle 722 between the rotor 720 and the sleeve bearing 748. Furthermore, a pin 752 formed of wear resistant material extends down from a turbine exit shroud or baffle 760 to make a substantially point contact with a top end of the axle 722 when the rotor 720 is drawn upward by the suction A applied to the tube 708. In addition, the direction in which the helical teeth on the gear shaft 736 twist about the shaft 736 is selected such that the engagement of the gear shaft 736 with the idler gear 738 creates a downward force on the shaft 736 and therefore on the turbine rotor 720 under load. This downward force counterbalances the upward force applied to the rotor 720 by the suction A in the suction tube. More particularly, the turbine 732 blades on the rotor 720 are designed to cause the rotor 720 to spin clockwise in top view and the helical teeth on the gear shaft 736 have a right hand or clockwise twist, such that clockwise motion of the rotor 720 causes the idler gear 738 to apply a downward force on the gear shaft 736.

The turbine rotor 720 is preferably somewhat bell shaped. The bell shape facilitates the flow of air through the turbine 706 and out the turbine outlet opening 726 by smoothly guiding the flow of air upward and out the turbine outlet opening 726. The bell shape also minimizes distortion of the rotor 720 under load. An additional benefit of the bell shape of the turbine rotor 720 is that it provides a recess 749 in a lower side 754 of the rotor as viewed in FIG. 22. The sleeve bearing 748 supporting the turbine axle in the lower end wall 734 is preferably located in a central raised portion 747 of the lower end wall 734, such that the top end 756 of the bearing is received in the recess 749 in the lower side of the turbine. Locating the sleeve bearing partially in the recess in the rotor decreases the vertical height required to mount rotor 720 and axle 722 in the housing 718 and provides a relatively compact construction. Locating the top end of the bearing above the lower end wall 734 also helps prevent any liquid pooling on the lower end wall 734 from entering the bearing 748. Any liquid that pools on the lower end wall 734 will run out the turbine inlet openings 724 when the suction being applied to the suction tube is turned off.

The brush 704 has bearing and brush mounting stem 781 integrally formed therewith. The brush bearing and mounting stem 781 is received in hollow cylindrical brush mounting post 782 extending down from a wall 783 separating the brush chamber from the gear chamber. In order to provide a compact brush assembly, the brush 704 has an annular recess 784 surrounding the stem 781 for receiving the mounting post 783 therein. The brush 704 is retained in place on the mounting post 782 by a lower brush retaining wall 786. The end of the stem 781 on the brush 704 abuts against an inner end surface 788 inside the mounting post 782. Thus, the brush 704 is held axially in place between the end surfaces 788 and the retaining wall 786. Bristles 715 on the brushes 704 extend out brush opening 790 in the retaining wall 786.

In operation, suction is applied to the suction tube 708, thereby applying suction simultaneously to the suction nozzle 702 and the air powered turbine 706. Thus, air is drawn simultaneously in through the suction nozzle inlet 703 for extracting liquid from a surface to be dried or cleaned and in through the turbine inlet openings 724 for operating the turbine 706 by driving the rotor 720, which in turn, drives the scrub brush 704 via the gear train 735.

An operator preferably simultaneously presses the suction inlet 703 and the scrub brush 704 against a surface to be cleaned and then depresses the trigger 634 while pulling the extractor nozzle accessory tool 700 in a rearward direction. Upon depressing the trigger 634, the spray mechanism sprays cleaning solution onto the carpet or other surface to be cleaned. The brush is then used to distribute the solution on the carpet or fabric and work the solution into the carpet or fabric with a scrubbing action. Further details of the accessory tool are shown in U.S. Pat. No. 6,1343,746; the disclosure of which is incorporated by reference.

Figure 26:
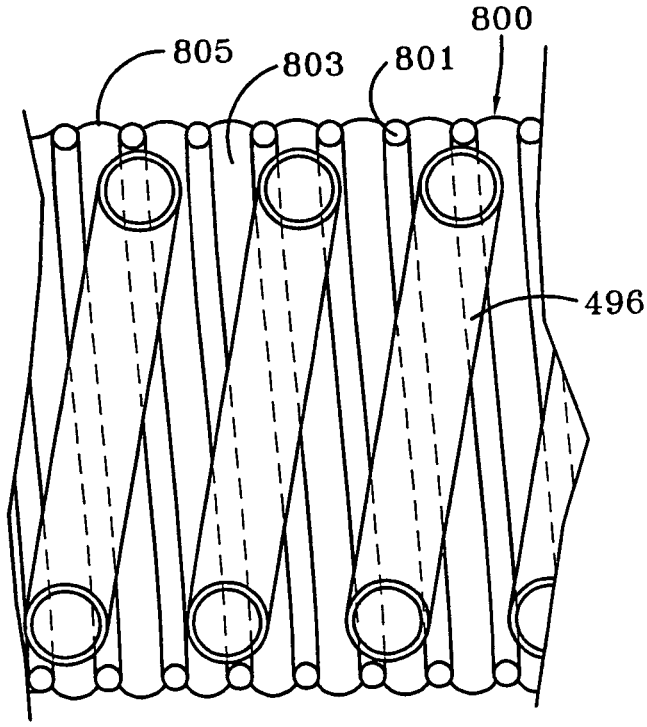
FIG. 26 is a partial section view taken along line 26-26 of FIG. 25.

Referring to FIGS. 11, 25, 26, 26A and 27, the accessory hose assembly 632 has a suction hose 800 that is corrugated and form of a suitable elastic material to allow it to extend its length. The solution tube 496 is placed inside the suction hose 800 in a helical coiled arrangement in order to allow it to also extend and retract in response to the suction hose 800 extending and retracting to a desired length. Referring to FIG. 26, the suction hose 800 is formed from a helically coiled support member 801 such as a steel wire, and an extruded or helically wound outer jacket 803 formed from a suitable flexible material, such as vinyl. This arrangement allows the outer jacket 803 to move as the support member 801 is extended and contracted, forming a stretch hose in which the length of the hose can be adjusted. One example of the outer portion of the stretch hose is shown in U.S. Pat. No. 3,486,532, which is hereby incorporated by reference. Although a steel wire and vinyl type stretch hose is preferred, a one-piece corrugated hose member could be used as shown in U.S. Pat. Nos. 3,572,393 and 5,395,278, which are hereby incorporated by reference.

Figure 26A:
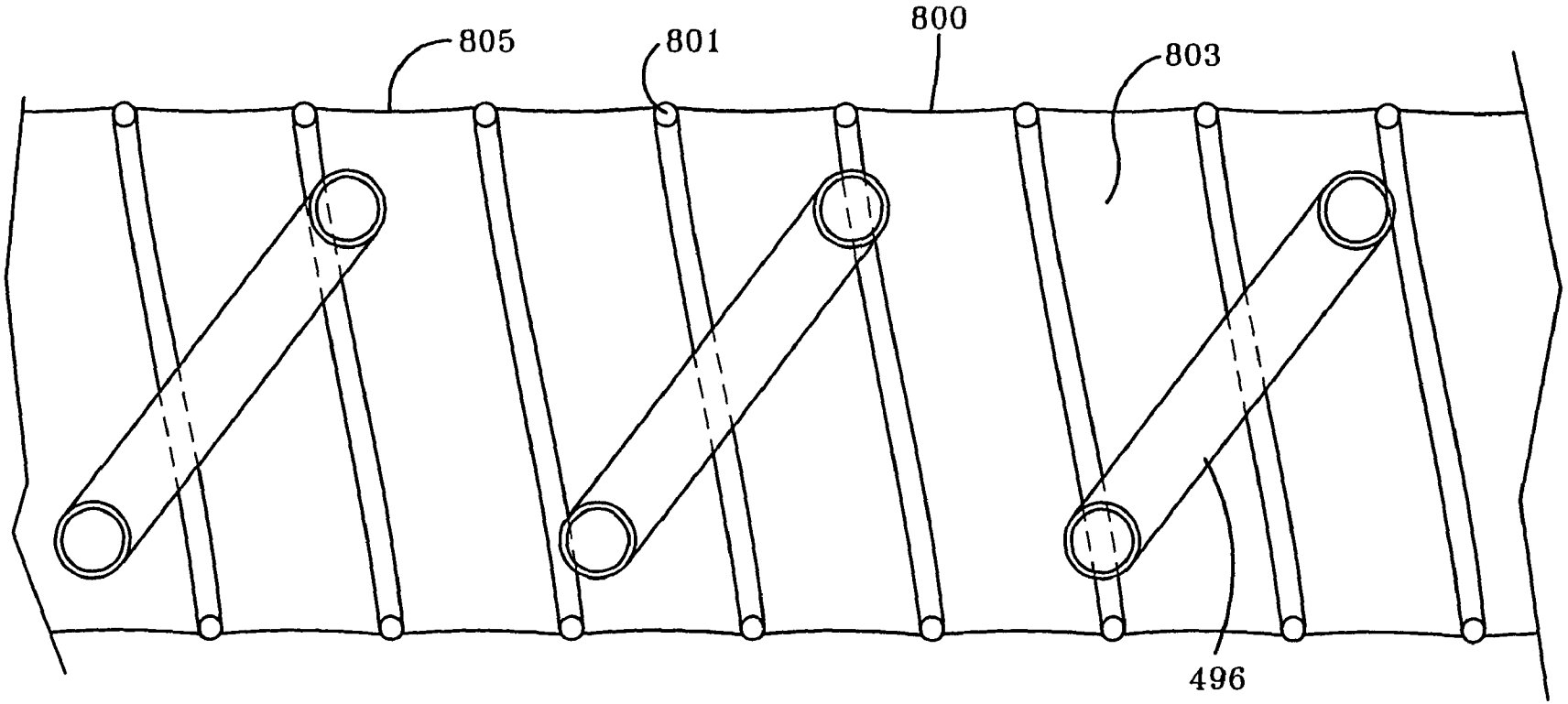
Figure 27:
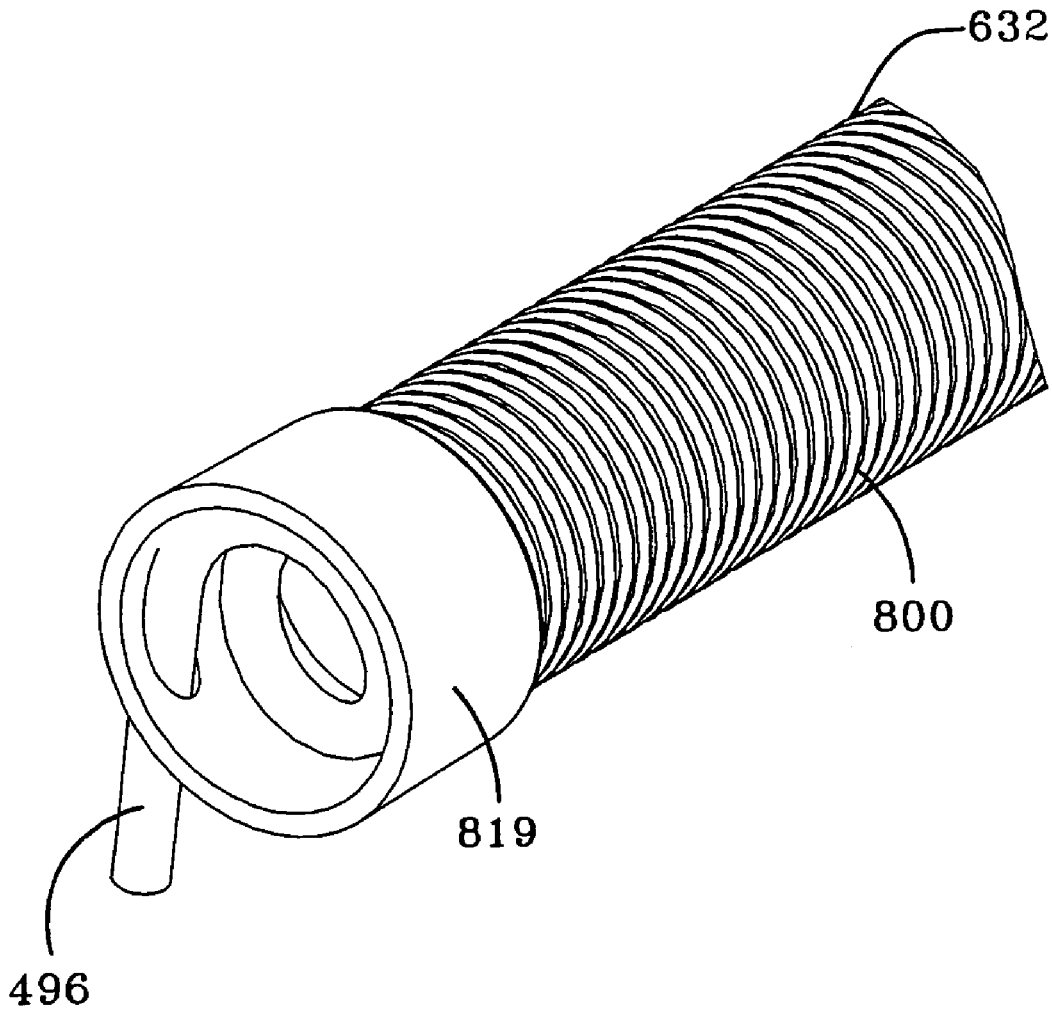
FIG. 27 is a perspective view of a portion of the accessory hose assembly in an alternative embodiment.

As illustrated, the stretch hose uses an outward convoluting stretch suction hose 800, in which the support member 801 defines the inner diameter of the suction hose 800, while the excess material of the outer jacket is displaced outwardly in the form a ring 805 from the support member 801 when the suction hose 800 is retracted, as shown in FIGS. 26 and 26A. Alternately, the stretch hose may use an inward convoluting stretch suction hose 800, in which the support member 801 defines the outer diameter of the suction hose 800, while the excess material of the outer jacket is displaced inwardly in the form a ring 805 from the support member 801 when the suction hose 800 is retracted the It is also preferred to orient the helical coils of the solution tube 496 opposite the orientation of the helically coiled support member 801. The solution tube 496 is not bonded to the outer jacket 803 of the suction hose 800 and is significantly shorter in straightened length than the straightened length of the helically coiled support member 801, to facilitate priming with cleaning solution. However, the solution tube could be bonded to the outer jacket or could form the support member 805. The solution tube 496 enters and leaves the suction hose 800 at rigid cuff member 807 in the perpendicular or radial direction. Alternatively, the solution tube 496 enters and leaves the suction hose 800 at cuff member 809 tangentially to reduce clogging in the suction hose 800 as depicted in FIG. 27. The solution tube 496 may or may not be bonded to the suction hose 800.

In the stretched position, shown in FIG. 26 A, it should be noted that the hose has increased in length by a factor of four hundred percent (400%) over the compressed position shown in FIG. 26. It should be noted that most suction hoses with a solution tube will not expand much over twenty five percent (25%) of the original length. Therefore, the present invention allows stretch configurations that are capable of expanding to 50%, 100%, 200%, 300%, 400% and greater. This large expansion ratio allows for a more compact suction hose in the storage position (FIG. 26) to have a greatly enhanced length when used (FIG. 26A).

The accessory hose assembly 632 is routed down from the accessory inlet 620 of the conversion valve assembly 484 and extends through an enclosed portion 802 of a hose retainer 804. The hose retainer 804 is mounted to the rear of the lower body shell 254 at a location near the bottom of the lower body shell 254. Such a location provides for a very low center of gravity at the connection of the accessory hose assembly 632 and hose retainer 804, thereby preventing the extractor unit 60 from tipping when the accessory hose assembly 632 is being used. The hose retainer 804 also includes a clip portion 806 extending outwardly and downwardly for releasably retaining a section of the accessory hose assembly 632 or accessory tool 700 if desired. The accessory hose assembly 632 wraps around a hook 808 integrally molded to the upper hand body.

Referring now to FIGS. 11 and 17, a retainer assembly 810 is mounted to the rear portion of the upper handle body 572 and includes a pair of retaining clips 812L, 812R located on opposite side ends to releasably retain the accessory hose assembly 632 to the rear side of the handle assembly 62. The retainer assembly 810 includes an integrally molded tongue 814 extending upwardly and outwardly, which is selectively inserted into the suction tube 708 of the accessory tool 700 to store the tool 700 on the extractor 60. The retainer assembly also includes an integrally molded carry handle 817 for carrying the extractor unit 60. An upper cord holder 820 is mounted to the retainer assembly 810 and upper handle body 572 and a lower cord holder 821 is integrally molded to the lower handle body shell 254. The distal hose end 638 is slidably received in a pocket member or holster 816 secured to the rear portion of the handle assembly 62 when it is stored on the unit.

As depicted in FIGS. 24 and 24A, a manual lever 818 is connected to the rotary valve member 628 to selectively pivot the valve member 628 between the two positions. An arm 822 is connected to the lever 818 and reciprocates or moves back and forth in response to pivotal movement of the lever 818. As seen in FIGS. 9 through 11, a cover 824 for the conversion valve assembly 484 is mounted to the rear portion of the lower handle body shell 254. The cover 824 includes a first lateral slot 826 in which the lever 818 extends therethrough for access by the user and a second lateral slot 827 (FIG. 9) in which the arm 822 extends and retracts therethrough. When the carpet extractor 60 is operated in the floor mode as seen in FIG. 11, the hose end 638 is received in the holster 816 and the lever 818 is at the position in the slot 826 furthest away from the holster 816. This places the valve member 628 over the outlet 621 of the accessory passageway 624, thereby partially blocking suction to the accessory passageway 624, accessory hose assembly 632, and accessory tool 700 as seen in FIG. 24A. The remaining suction through the accessory passageway 624, accessory hose assembly 632, and accessory tool 700 is blocked or shut off by bottom wall 828 of the holster 816. Thus, working air, including entrained fluid and dirt, is drawn into the floor suction nozzle assembly 174, through the floor recovery duct 222, floor recovery hose 228, entrance passageway of the conversion valve and to the lid assembly 324 of the recovery tank 80.

To operate the carpet extractor 60 in the upholstery or above the floor cleaning mode as depicted in FIGS. 10 and 24, a user removes the distal hose end 638 of the accessory hose assembly 632 from the holster 816 and mounts the accessory tool 700 to the hose end 638. The user then moves or rotates the lever 818 counterclockwise (as viewed from the top) to the other end 838 of the slot 826, which in turn rotates the valve member 628 away from the outlet 621 of the accessory passageway 624 and over the outlet 830 of the floor passageway 832 to partially or substantially block suction through the floor recovery duct 222, floor recovery hose 228, and floor suction nozzle 174. Yet, suction is created in the flowpath through the accessory passageway 624, accessory hose assembly 632, and accessory tool 700. Thus, suction generated by the motor draws dirt and liquid through the accessory tool 700, suction hose 800, accessory passageway 624, entrance passageway 486 and into the recovery tank 80 as seen by the arrows. Also, movement of the lever 818 to the upholstery mode position causes the arm 822 to extend through the slot 827 (FIG. 9) partially over the bottom wall 828 of the holster 816 as seen in FIG. 10. In this position, the arm 822 prevents the hose end 638 from being inserted into the holster 816 until the lever 818 is moved back to the slot end 836 furthest away from the holster 816 to retract the arm 822 and position the valve member 628 over the outlet 621 of the accessory passageway 624 for operation in the floor mode.

Figure 21:
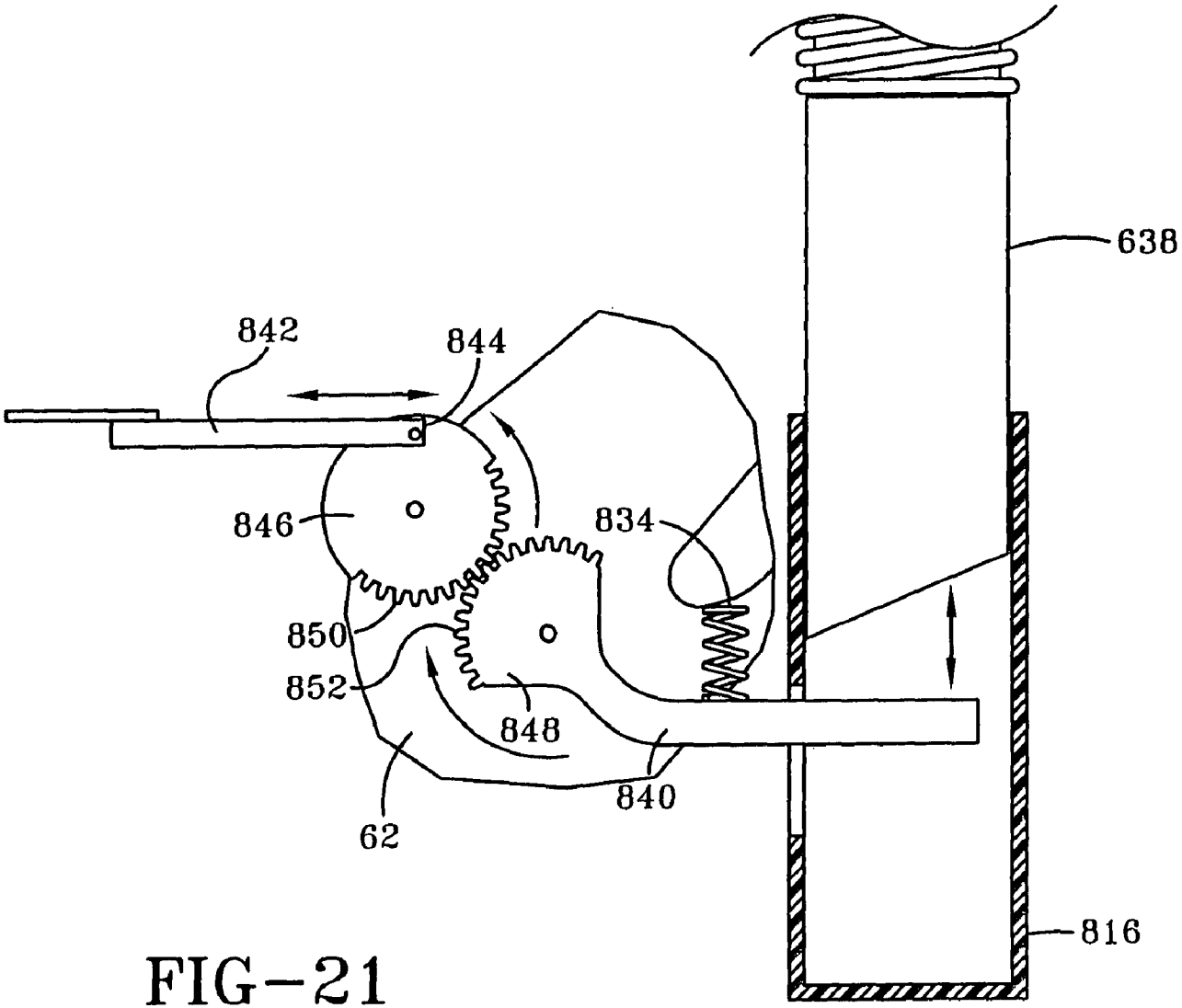
FIG. 21 is an alternative arm and lever arrangement of the conversion valve assembly of the carpet extractor of FIG. 1.
Figure 21A:
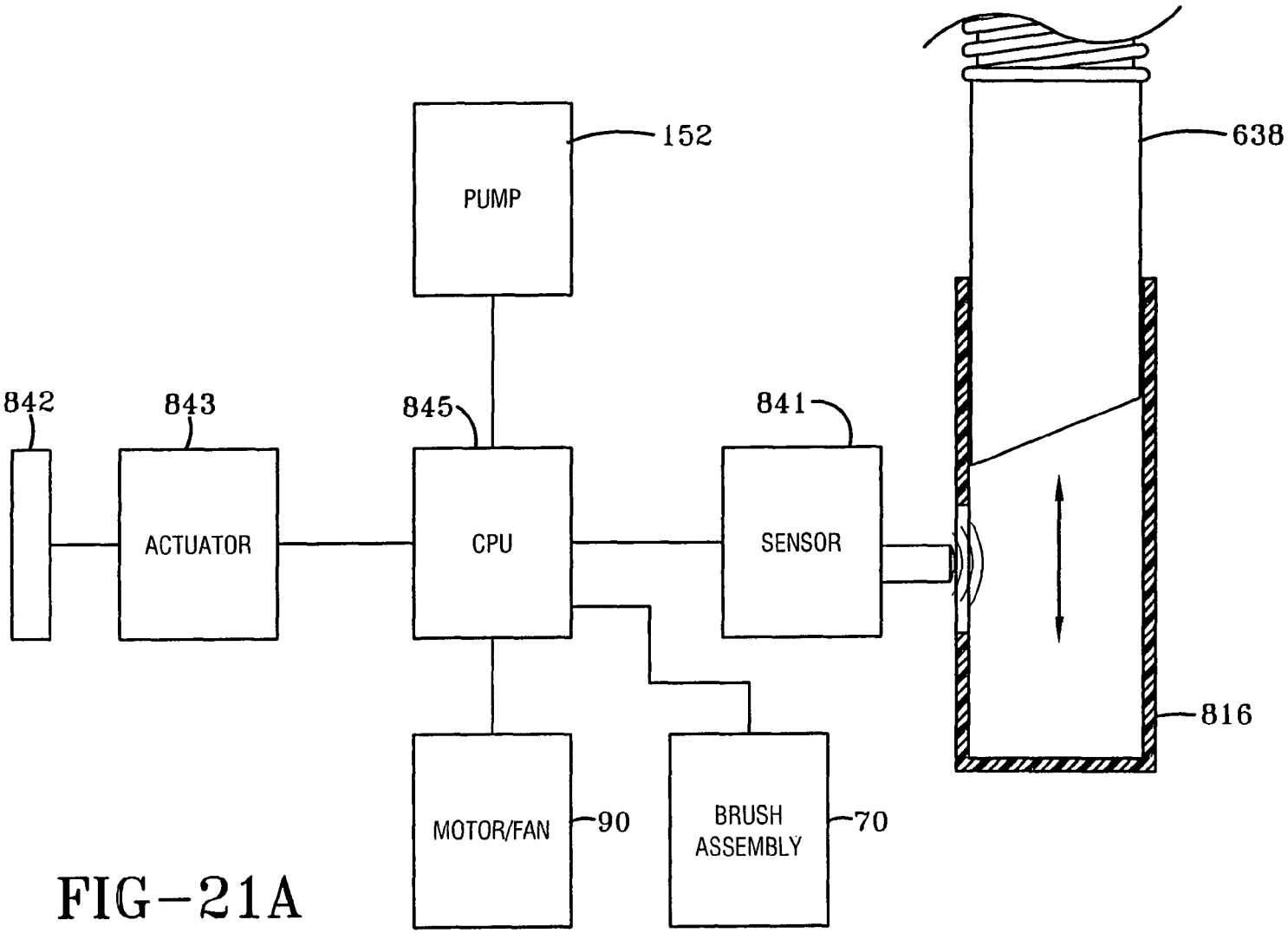
FIG. 21A is a second alternative arrangement similar to that shown in FIG. 21.

As seen in FIG. 21, an alternative arm and lever arrangement is designed such that the hose end 638 cams against arm 840, when inserted in to the holster 816, to retract the arm 840, which causes lever 842 to position the valve member 628 over the outlet 621 of the accessory passageway 624 for operation in the floor mode. In particular, the arm 840 is pivotally attached to the handle assembly 62 at its proximal end 848. The distal end 844 of the lever 842 is attached to the outer end of gear 846, which is rotatably connected to the handle assembly 62. Rotation of the gear 846 causes the lever 842 to reciprocate. The gear 846 includes teeth 850 which intermesh with teeth 852 formed on the proximal end 848 of the arm. A spring 834, attached between the handle assembly 62 and the arm 840, biases the arm 840 upwardly and causes the lever 842 to position the valve member 628 over the outlet 830 of the floor passageway 832. When the hose end 638 is inserted in the holster 816, it cams or pushes down on the arm 840 causing the arm 840 to retract which causes the lever 842 to position the valve member 628 over the outlet 621 of the accessory passageway 624 for operation in the floor mode. When the hose end 638 is removed from the holster 816 for upholstery or above the floor use of the carpet extractor 60, the spring 834 urges the arm 840 upwardly and positions the valve member 628 over the outlet 830 of the floor passageway 832.

Referring now to FIG. 21A, a second alternative arrangement is shown to sense when the hose end 638 is moved into and out of position within the holster 816. In particular, the sensor 841 senses the presence of the hose end 638 and sends control signals to the CPU 845. The sensor 841 may be any one of a micro switch, hall effect sensor, infared sensor, optical sensor or any other suitable sensor that may detect the presence of the hose end 838 within the holster 816. The CPU 845 contains logic which may be used to (1) control an actuator 843 to actuate the lever 842 and control airflow to the floor nozzle, (2) control the speed of the motor/fan unit 90 if it is desirable to increase or decrease fan speed when the accessory tool is being used, (3) start the pump 152 to start and stop the flow of cleaning fluid to the fluid conduit 496 when the accessory hose is in use, (4) control the speed of the brush assembly to stop the brushes when the accessory hose is in use, or (5) control some other operation that is only desired when the hose end 638 is removed from the holster 816. It should be noted that the CPU control of features is not presented here in great detail, but should readily be implemented by one skilled in the art of designing floor care appliance.

In use, the carpet extractor 60 distributes the cleaning solution on the carpet 74 upon squeezing of the trigger 568 as it substantially and simultaneously extracts it along with the dirt on the carpet in a continuous operation. Optionally, the carpet extractor can be self-propelled or include a heater for heating the cleaning solution. Also, a tablet composed of fragrance emitting material can be placed within the solution tank 76 and mixed with the cleaning solution to produce the desired fragrance after cleaning the carpet. Further, the bristles 69, 715 of their respective brushes 72, 704 may be composed of anitmicrobial material. Such a tablet and antimicrobial bristle material is disclosed in co-pending patent application having Ser. No. 10/714,808; the disclosure of which is incorporated by reference. The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A cleaning apparatus for cleaning a surface in which cleaning solution is dispensed to the surface and substantially simultaneously extracted along with the dirt on the surface in a continuous operation comprising:

a) a base portion for movement along the surface; b) a handle pivotally connected to said base portion; c) a solution tank for supplying a flow of cleaning solution to the surface, said solution tank removably mounted to one of said handle and said base portion; d) a recovery tank removably mounted to said handle; e) a suction nozzle secured to said base portion and in fluid communication with said recovery tank; f) a suction source in fluid communication with said suction nozzle for generating suction to draw dirt and liquid through said suction nozzle and into said recovery tank; and g) said handle includes a single laterally extending support member, said recovery tank includes a lower portion, said lower portion including a recess, said recess slidably receiving said support member for supporting said recovery tank substantially minimizing side by side movement of the recovery tank upon said recovery tank being mounted to said handle.

2. The cleaning apparatus of claim 1 wherein said recess is formed in the underside of said lower portion.

3. The cleaning apparatus of claim 1 wherein said recovery tank includes a pair of opposite side recess portions for grasping by a user for ease of removal of said recovery tank from said handle.

4. The cleaning apparatus of claim 1 wherein said suction source is mounted to said base portion.

5. The cleaning apparatus of claim 1 wherein said one of said solution tank and said recovery tank is said recovery tank.

6. The cleaning apparatus of claim 1 wherein said recovery tank is slidably but not pivotally mounted to said handle.

7. A cleaning apparatus for cleaning a surface in which cleaning solution is dispensed to the surface and substantially simultaneously extracted along with the dirt on the surface in a continuous operation comprising:

a) a base portion for movement along the surface; b) a handle pivotally connected to said base portion; c) a solution tank for supplying a flow of cleaning solution to the surface, said solution tank removably mounted to one of said handle and said base portion; d) a recovery tank removably mounted to said handle, said recovery tank having an upper portion; e) a suction nozzle secured to said base portion and in fluid communication with said recovery tank; f) a suction source mounted to said base portion in fluid communication with said suction nozzle for generating suction to draw dirt and liquid through said suction nozzle and into said recovery tank; and g) a pair of latches located on opposite sides of said upper portion of said recovery tank for releasably latching said recovery tank to said handle, wherein at least one of said latches includes a front portion, said upper portion of said recovery tank including a notch, said front portion engaging said notch to latch said recovery tank to said handle, said front portion disengaging said notch to unlatch said recovery tank from said handle; and wherein said one latch is pivotally connected to said handle and includes a rear portion, wherein depressing said rear portion of said latch disengages said front portion from said notch to unlatch said recovery tank from said handle, and depressing said front portion engages said front portion to said notch to latch said recovery tank to said handle; and wherein said handle includes a laterally extending support member, said recovery tank includes a lower portion, said lower portion including a recess, said recess slidably receiving said support member for supporting said recovery tank when said recovery tank is being mounted to said handle.

8. The cleaning apparatus of claim 7 wherein said recess is formed in the underside of said lower portion.

9. The cleaning apparatus of claim 7 wherein said suction source is mounted to said base portion.

10. The cleaning apparatus of claim 7 wherein said one of said solution tank and said recovery tank is said recovery tank.

11. The cleaning apparatus of claim 7 wherein said recovery tank includes a pair of opposite side recess portions for grasping by a user for ease of removal of said recovery tank from said handle.

12. The cleaning apparatus of claim 7 wherein said recovery tank is slidably but not pivotally mounted to said handle.

* * * * *